US012796778B2

(12) United States Patent
Kozuka et al.

(10) Patent No.: US 12,796,778 B2
(45) Date of Patent: Nov. 17, 2026

(54) SHOE

(71) Applicant: ASICS CORPORATION, Kobe (JP)

(72) Inventors: Yuya Kozuka, Kobe (JP); Shigeyuki Mitsui, Kobe (JP); Yuta Kawai, Kobe (JP); Arisa Mochida, Kobe (JP); Yasutaka Matsuo, Kobe (JP)

(73) Assignee: ASICS CORPORATION, Kobe (JP)

( * ) Notice: Subject to any disclaimer, the term of this patent is extended or adjusted under 35 U.S.C. 154(b) by 0 days.

(21) Appl. No.: 19/277,987

(22) Filed: Jul. 23, 2025

(65) Prior Publication Data

US 2026/0026574 A1 Jan. 29, 2026

(30) Foreign Application Priority Data

Jul. 26, 2024 (JP) ..... 2024-121034

(51) Int. Cl.
*A43B 23/02* (2006.01)

(52) U.S. Cl.
CPC ..... *A43B 23/0205* (2013.01); *A43B 23/0275* (2013.01)

(58) Field of Classification Search
CPC ..... A43B 23/0205; A43B 23/042; A43B 23/0215; A43B 23/0245; A43B 23/0235; A43B 23/088; A43B 23/08; A43B 23/0275
See application file for complete search history.

(56) References Cited

U.S. PATENT DOCUMENTS

2002/0078599 A1* 6/2002 Delgorgue ..... A43B 1/04 12/146 D
2010/0037483 A1* 2/2010 Meschter ..... A43B 3/26 36/47
2010/0199520 A1* 8/2010 Dua ..... B29C 66/43 264/293

(Continued)

FOREIGN PATENT DOCUMENTS

JP 2022-127292 A 8/2022
JP 2022-127293 A 8/2022

OTHER PUBLICATIONS

The extended European search report issued by the European Patent Office on Nov. 5, 2025, which corresponds to European Patent Application No. 25191772.0-1015 and is related to U.S. Appl. No. 19/277,987.

*Primary Examiner* — Jameson D Collier
(74) *Attorney, Agent, or Firm* — Studebaker Brackett PLLC

(57) ABSTRACT

A shoe includes a shell made of an elastic material, the shell including a bottom wall portion and a peripheral wall portion. A bulging portion, which bulges toward an insertion space configured to receive a foot of a wearer and includes an easy-deformable portion configured of a three-dimensional mesh structure body, is provided at a position of the peripheral wall portion corresponding to at least one of a portion behind a medial malleolus point of the wearer's foot and a portion behind a lateral malleolus point of the wearer's foot. A highly rigid portion is provided at a position of the peripheral wall portion lower than a portion of the peripheral wall portion provided with the bulging portion. At least a portion of the peripheral wall portion including the bulging portion and the highly rigid portion is configured of a single member.

14 Claims, 20 Drawing Sheets

(56) References Cited

U.S. PATENT DOCUMENTS

| | | | | |
|---|---|---|---|---|
| 2011/0185592 | A1* | 8/2011 | Nishiwaki | A43B 23/17<br>36/69 |
| 2014/0310984 | A1* | 10/2014 | Tamm | A43B 1/04<br>36/45 |
| 2019/0029369 | A1* | 1/2019 | VanWagnen | B33Y 80/00 |
| 2021/0259364 | A1 | 8/2021 | Takashima et al. | |
| 2022/0264997 | A1 | 8/2022 | Hatano et al. | |
| 2022/0266561 | A1 | 8/2022 | Wakasugi et al. | |
| 2023/0058209 | A1* | 2/2023 | Siegismund | A43B 7/143 |
| 2026/0026576 | A1* | 1/2026 | Kozuka | A43B 23/0235 |

* cited by examiner

SHOE

REFERENCE TO RELATED APPLICATIONS

This nonprovisional application is based on Japanese Patent Application No. 2024-121034 filed on Jul. 26, 2024 with the Japan Patent Office, the entire contents of which are hereby incorporated by reference.

BACKGROUND

Technical Field

The present disclosure relates to a shoe.

Background Information

For example, Japanese Patent Laying-Open No. 2022-127292 and Japanese Patent Laying-Open No. 2022-127293 disclose shoes each including a flexible shell, an upper body having a bag-like shape accommodated inside the shell, and a sole body disposed at a predetermined position inside the shell. In the shoes disclosed in these publications, the flexible shell has a bottom wall portion and a peripheral wall portion, and at the time of wearing, the bottom wall portion supports a sole of a foot of a wearer, while the peripheral wall portion covers a peripheral surface of the foot of the wearer.

SUMMARY

Generally, in a shoe, it is preferable to achieve both fit during low-strength exercise (so-called stationary fit) such as a state in which the wearer is stationary or walking at a low speed and fit during high-strength exercise (so-called dynamic fit) such as a state in which the wearer is walking or running at a high speed.

In this regard, it is conceivable that in the shoes as disclosed in the above publications, in order to improve the stationary fit, the shape of the inner surface of the peripheral wall portion of the shell substantially matches the shape of the peripheral surface of the foot of the wearer so that an appropriate pressure is applied to the peripheral surface of the foot of the wearer. However, such a configuration alone does not necessarily improve the dynamic fit.

That is, the improvement of the dynamic fit is realized only when the shoe deforms in response to the movement of the foot (so-called foot bending motion or the like) while still maintaining the application of an appropriate pressure to the peripheral surface of the foot of the wearer described above even during such deformation. However, it is not necessarily easy to realize this.

Particularly, the portion of the peripheral surface of the foot of the wearer, the portion being located behind the medial and lateral malleoli, is recessed more than the peripheral portion thereof, and a topline for inserting the foot of the wearer is located above the shell covering the portion. Therefore, it is very difficult to enhance the dynamic fit of the shell with respect to the foot at a position behind the medial and lateral malleoli, and in a case where the dynamic fit of this portion is extremely inferior, the shoe may fall off the foot of the wearer during high-strength exercise.

Therefore, the object of the present disclosure is to improve the stationary fit and the dynamic fit of the shell with respect to the foot at the position behind the malleolus of the foot of the wearer in the shoe including the flexible shell made of the elastic material.

A shoe according to one aspect of the present disclosure includes a shell including an insertion space inside the shell and configured to receive a foot of a wearer, the shell being made of an elastic material, and surrounding the insertion space. The shell includes a bottom wall portion configured to support a sole of the foot of the wearer, and a peripheral wall portion that is configured to cover a peripheral surface of the foot of the wearer by standing from a peripheral edge of the bottom wall portion. A bulging portion, which bulges toward the insertion space and includes an easy-deformable portion configured of a three-dimensional mesh structure body, is at a position of the peripheral wall portion corresponding to at least one of a portion behind a medial malleolus point of the foot of the wearer and a portion behind a lateral malleolus point of the foot of the wearer. A highly rigid portion, which is a hard-deformable portion having higher rigidity than the easy-deformable portion, is at a position of the peripheral wall portion lower than a portion of the peripheral wall portion provided with the bulging portion. In the shoe according to one aspect of the present disclosure, at least a portion of the peripheral wall portion including the bulging portion and the highly rigid portion is configured of a single member.

Note that the medial malleolus point means a portion most protruding toward a first toe of a medial malleolus at the end of a tibia, and the lateral malleolus point means a portion most protruding toward a fifth toe of a lateral malleolus at the end of a fibula.

DETAILED DESCRIPTION

Figure 1:
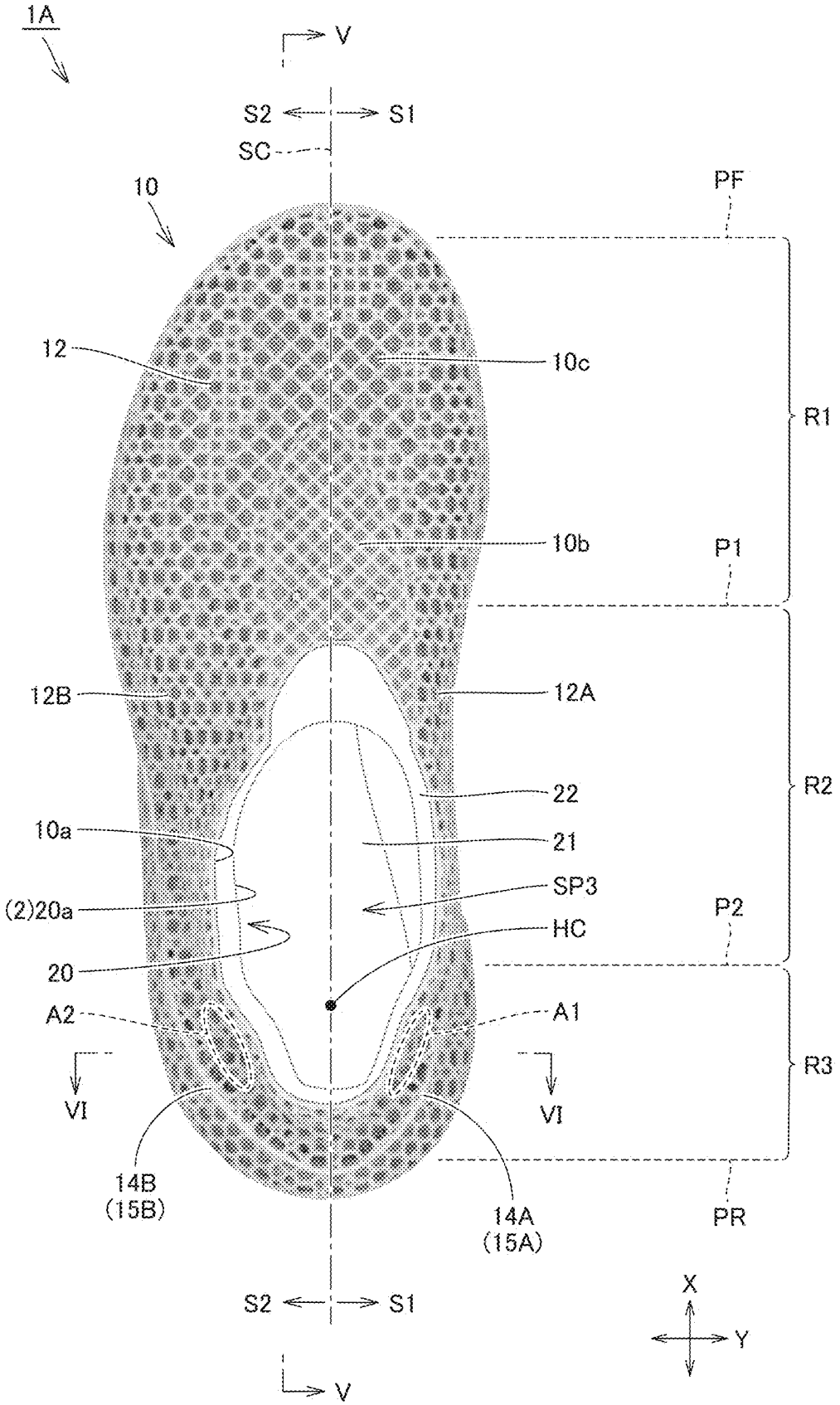
FIG. 1 is a plan view of a shoe according to Embodiment 1.

Hereinafter, embodiments will be described in detail with reference to the drawings. In the embodiment described below, the same or common portions are denoted by the same reference signs in the drawings, and description thereof will not be repeated.

Embodiment 1

<A. Schematic Configuration of Shoe>

Figure 2:
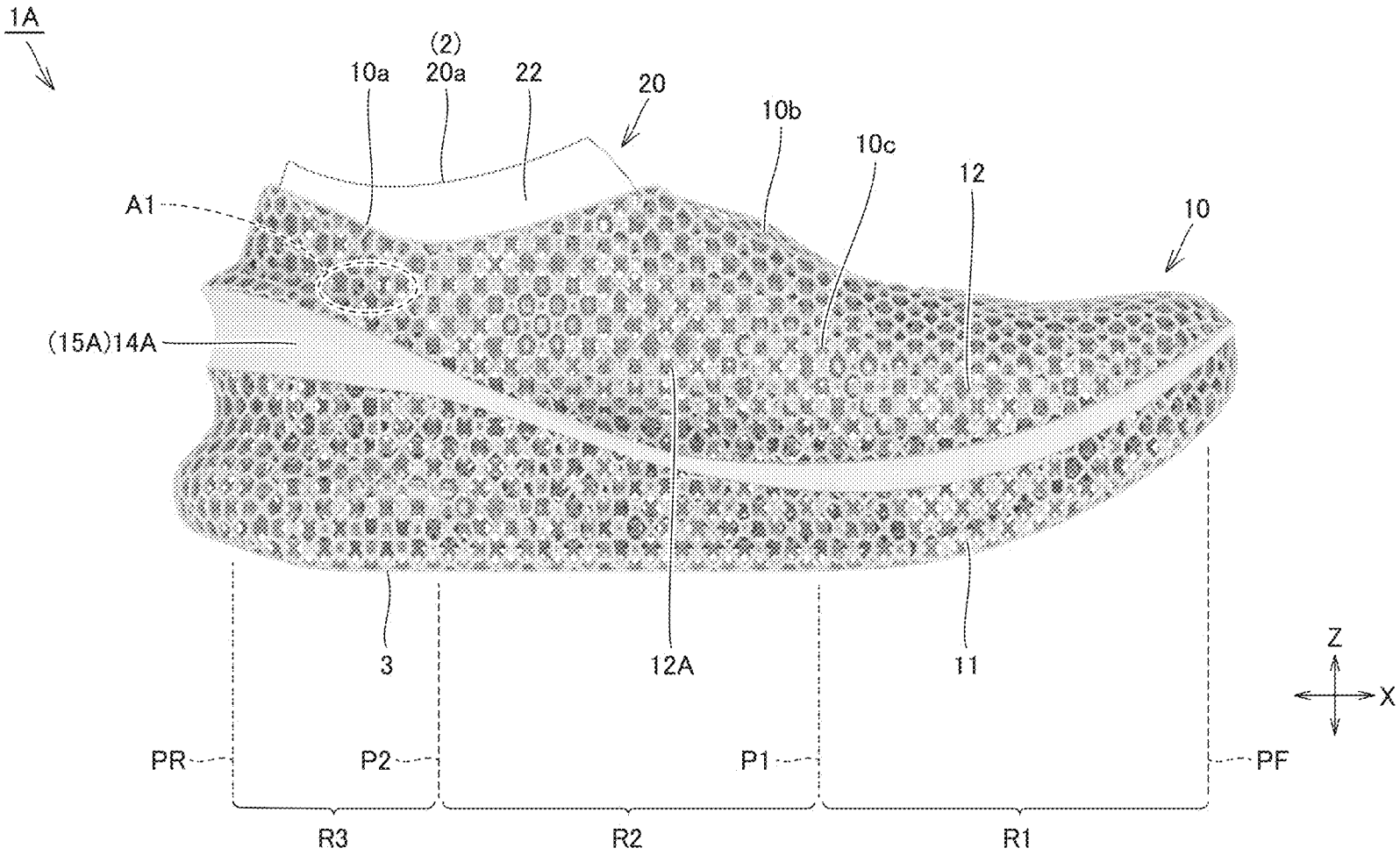
FIG. 2 is a side view of the shoe illustrated in FIG. 1 as viewed from a medial foot side.
Figure 3:
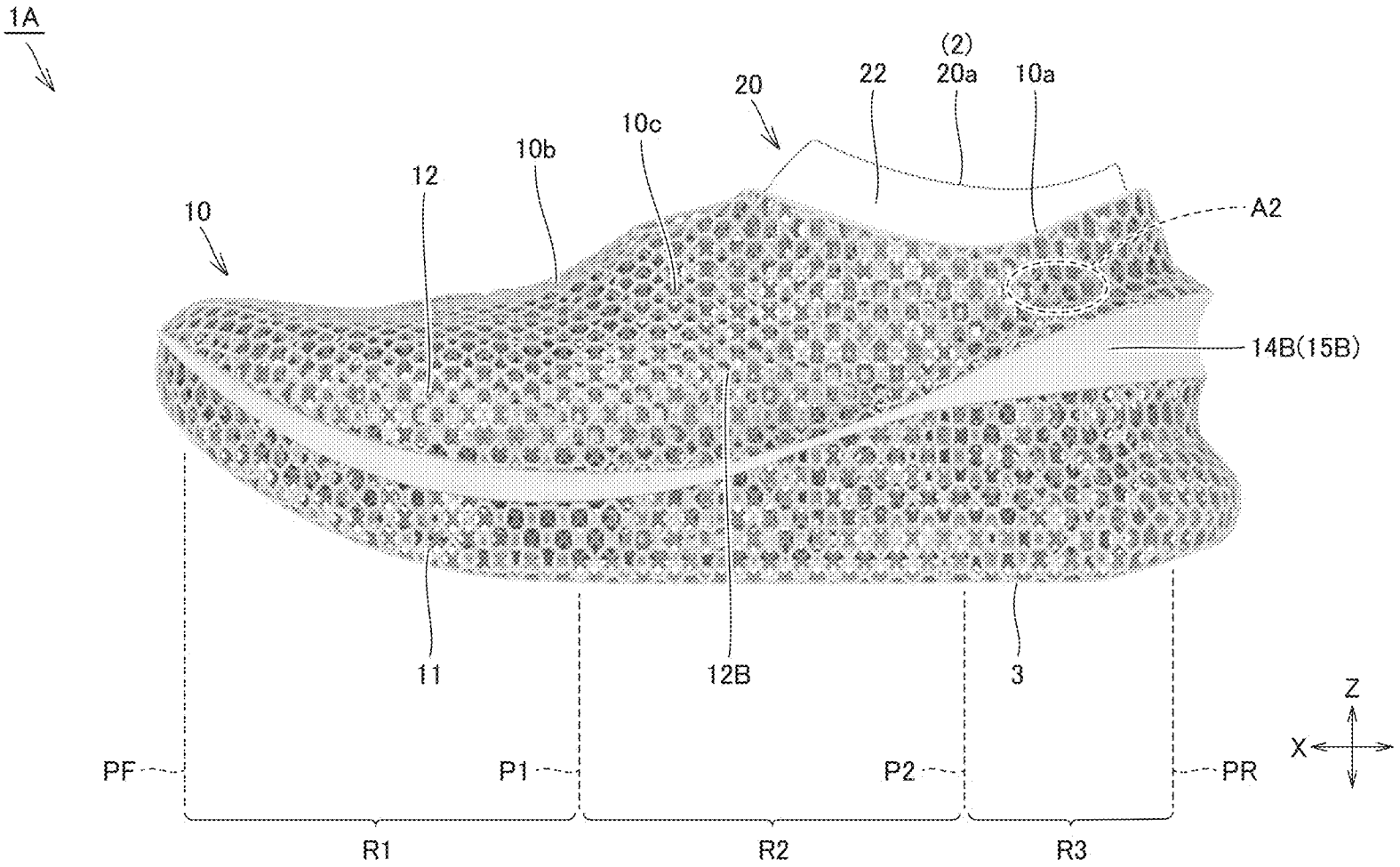
FIG. 3 is a side view of the shoe illustrated in FIG. 1 as viewed from a lateral foot side.
Figure 4:
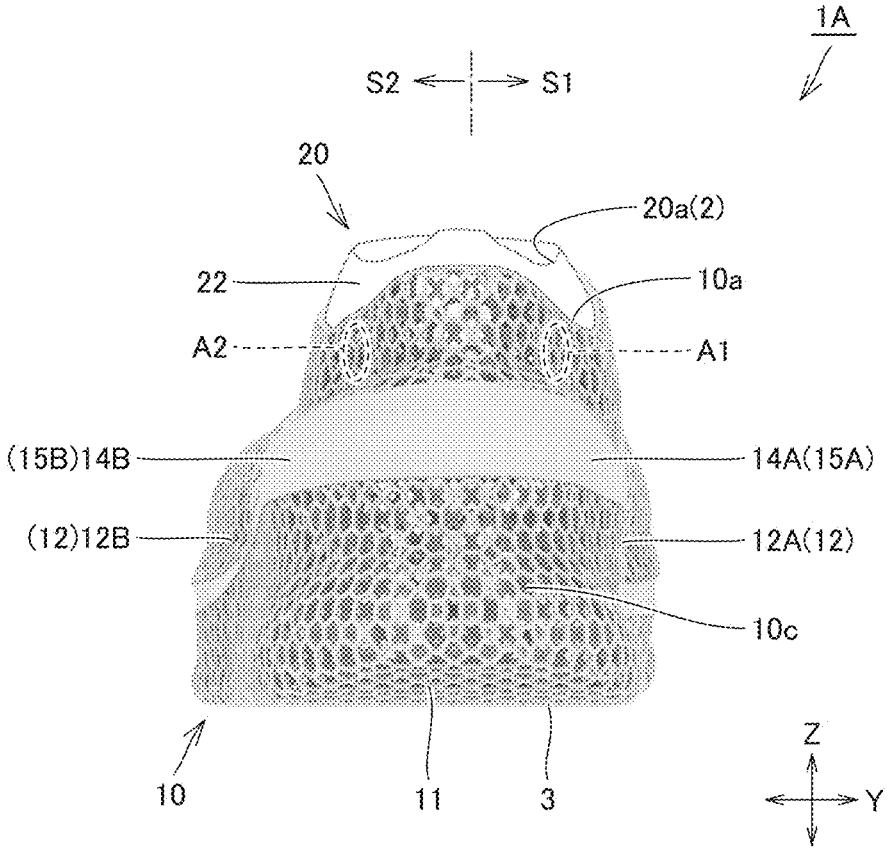
FIG. 4 is a rear view of the shoe illustrated in FIG. 1 as viewed from a rear side.
Figure 5:
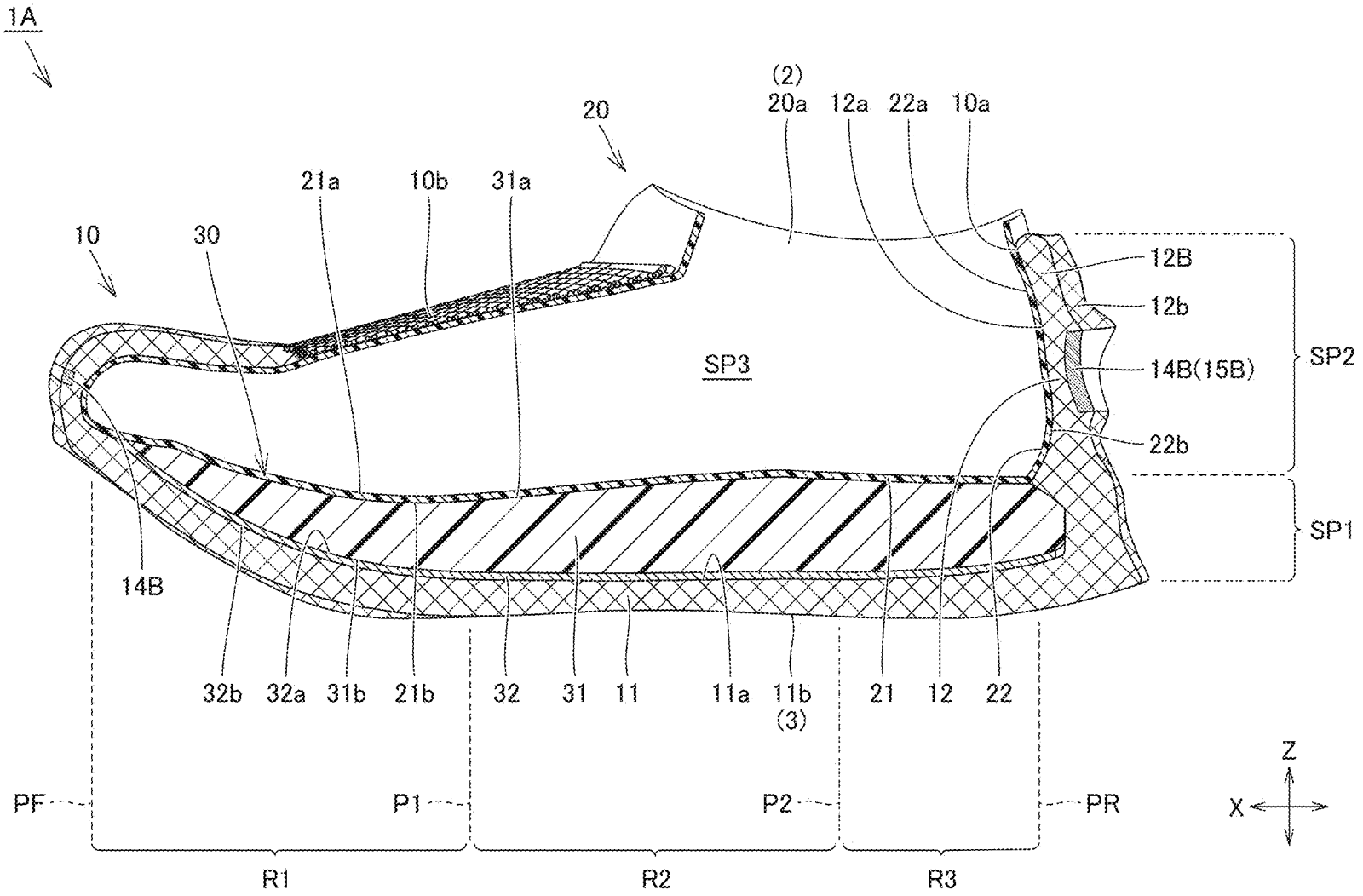
FIG. 5 is a schematic cross-sectional view of the shoe illustrated in FIG. 1 taken along line V-V illustrated in FIG. 1.

FIG. 1 is a plan view of a shoe according to Embodiment 1, and FIGS. 2 and 3 are side views of the shoe illustrated in FIG. 1 as viewed from a medial foot side and a lateral foot side, respectively. FIG. 4 is a rear view of the shoe illustrated in FIG. 1 as viewed from a rear side, and FIG. 5 is a schematic cross-sectional view of the shoe illustrated in FIG. 1 taken along line V-V illustrated in FIG. 1. First, a schematic configuration of a shoe 1A according to the present embodiment will be described with reference to FIGS. 1 to 5.

As illustrated in FIGS. 1 to 5, the shoe 1A according to the present embodiment has a sock shape that covers substantially the entire foot of a wearer (that is, sites on the distal side of the ankle). The shoe 1A includes a shell 10, an upper body 20, and a sole body 30 (see FIG. 5). A topline 2 that is a portion for inserting a foot is provided in an upper portion of the shoe 1A, and a ground contact surface 3 that contacts the ground or the like is provided in a lower portion of the shoe 1A. In addition, an insertion space SP3 (see FIGS. 1 and 5), which is a space into which the foot of the wearer is inserted, is provided inside the shoe 1A.

Here, the front-rear direction X of the shoe 1A is defined as a direction matching the foot length direction of the foot of the wearer wearing the shoe 1A. Furthermore, the left-right direction Y of the shoe 1A is defined as a direction matching the foot width direction of the foot of the wearer wearing the shoe 1A. Furthermore, the up-down direction Z of the shoe 1A is defined as a direction orthogonal to both the front-rear direction X and the left-right direction Y described above. Particularly, the up-down direction Z is substantially orthogonal to the ground contact surface 3 included in a midfoot portion R2 and a rearfoot portion R3 of the shoe 1A to be described later.

As illustrated in FIGS. 1 to 3 and FIG. 5, the shoe 1A includes, in the front-rear direction X, a forefoot portion R1 configured to support a toe portion and a ball portion of the foot of the wearer, the midfoot portion R2 configured to support an arch portion of the foot of the wearer, and a rearfoot portion R3 configured to support a heel portion of the foot of the wearer.

The forefoot portion R1, the midfoot portion R2, and the rearfoot portion R3 are defined as follows based on a shoe center SC (see FIG. 1) of the shoe 1A. Here, the shoe center SC is a straight line obtained in a case where, when a standard wearer having a foot of a size suitable for the shoe 1A wears the shoe 1A, a straight line connecting a portion between the first toe and the second toe of the wearer and a central portion of a calcaneus (so-called heel center (the heel center is indicated by a reference sign HC in FIG. 1)) is projected on the shoe 1A in the up-down direction Z. The direction in which the shoe center SC extends coincides with the front-rear direction X described above. As a premise, the foremost end and the rearmost end of the insertion space SP3 in the front-rear direction X which are positions on the shoe center SC are referred to as front end position PF and rear end position PR, respectively, and the distance between the front end position PF and the rear end position PR in the front-rear direction X is referred to as the entire length of the insertion space SP3.

That is, when a virtual plane passing through a position of 40% with respect to the entire length of the insertion space SP3 from the front end position PF and orthogonal to the shoe center SC is defined as a first boundary plane P1, and a virtual plane passing through a position of 80% with respect to the entire length of the insertion space SP3 from the front end position PF and orthogonal to the shoe center SC is defined as a second boundary plane P2, the forefoot portion R1 corresponds to a portion included between the front end position PF and the first boundary plane P1 in the front-rear direction X, the midfoot portion R2 corresponds to a portion included between the first boundary plane P1 and the second boundary plane P2 in the front-rear direction X, and the rearfoot portion R3 corresponds to a portion included between the second boundary plane P2 and the rear end position PR in the front-rear direction X.

In addition, as illustrated in FIG. 1 and FIG. 4, the shoe 1A is divided, along the left-right direction Y in a plan view, into a portion on the medial foot side (a portion on the S1 side illustrated in the drawing) which is the median side (that is, the side close to the median line) in the anatomical normal position of the foot and a portion on the lateral foot side (a portion on the S2 side illustrated in the drawing) which is the side opposite to the median side (that is, the side far from the median line) in the anatomical normal position of the foot.

As illustrated in FIGS. 1 to 5, in the shoe 1A, the upper body 20 and the sole body 30 are accommodated in the shell 10. More specifically, the sole body 30 is disposed at a position below the interior of the shell 10, and the upper body 20 is disposed at a position above the interior of the shell 10 in a manner of being positioned on the sole body 30. Accordingly, the sole body 30 is sandwiched between the shell 10 and the upper body 20. The shell 10, the upper body 20, and the sole body 30 are all located across the forefoot portion R1, the midfoot portion R2, and the rearfoot portion R3.

The shell 10 constitutes the outermost shell of the shoe 1A, and is constituted by a flexible member made of an elastic material formed in a bag-like shape having a mouth portion 10*a* which is opening-shaped. The shell 10 has an internal space leading to the mouth portion 10*a*, and the above-described insertion space SP3 is included in the internal space. As described above, the upper body 20 and the sole body 30 are disposed in the internal space of the shell 10.

The shell 10 includes a bottom wall portion 11 configured to cover the sole of the foot of the wearer and a peripheral wall portion 12 configured to cover the peripheral surface of the foot of the wearer. The peripheral wall portion 12 stands in a manner of continuously extending upward from the peripheral edge of the bottom wall portion 11.

As illustrated in FIG. 5, the bottom wall portion 11 has an inner surface 11*a* and an outer surface 11*b* which are a pair of main surfaces. The inner surface 11*a* is located on the insertion space SP3 side, and the outer surface 11*b* constitutes the outermost surface located on the lower side in the up-down direction Z of the shoe 1A. The outer surface 11*b* of the bottom wall portion 11 corresponds to the above-described ground contact surface 3, whereby the bottom wall portion 11 has the ground contact surface 3.

The peripheral wall portion 12 has an inner peripheral surface 12*a* and an outer peripheral surface 12*b* which are a pair of main surfaces. The inner peripheral surface 12*a* is located on the insertion space SP3 side, and the outer peripheral surface 12*b* constitutes the outermost surface located in the front-rear direction X of the shoe 1A, the outermost surface located in the left-right direction Y of the shoe 1A, and the outermost surface located on the upper side in the up-down direction Z of the shoe 1A.

As illustrated in FIGS. 1 to 5, the peripheral wall portion 12 includes a medial foot side peripheral wall portion 12A configured to cover a portion on the medial foot side of the foot of the wearer and a lateral foot side peripheral wall portion 12B configured to cover a portion on the lateral foot side of the foot of the wearer.

Here, particularly, in the above-described peripheral wall portion 12, a portion configured to cover the instep of the foot of the wearer (that is, a portion of the peripheral wall portion 12 located on the upper side in the up-down direction Z), unlike other portions included in the peripheral wall portion 12, is configured to have a small thickness and is formed of a mesh-like structure portion 10*b* consisting of a plurality of linear portions crossing each other in a direction orthogonal to the thickness direction.

With such a configuration, a portion of the peripheral wall portion 12 configured to cover the instep of the foot of the wearer has a lower tensile elastic modulus and a lower bending rigidity than other portions included in the peripheral wall portion 12. Therefore, the portion can be more flexibly deformed. Therefore, at the time of wearing, it is possible to improve fit while preventing excessive pressure from being applied to the instep of the foot of the wearer (particularly, the ridgeline portion of the instep), and moreover, bending of the shoe 1A at the time of running or walking is less likely to be hindered, and the shoe 1A is more likely to follow the movement of the foot. In addition, the shoe 1A can be put on and taken off more easily.

Note that the portion of the peripheral wall portion 12 configured to cover the instep of the foot of the wearer may include a mesh-like structure portion in which polygons such as triangles and quadrangles are regularly arranged or a mesh-like structure portion in which lines obtained by Voronoi division are traced, in addition to the above-described structure.

The above-described mouth portion 10*a* is provided at the upper end of the peripheral wall portion 12. The mouth portion 10*a* is positioned across the midfoot portion R2 and the rearfoot portion R3. The mouth portion 10*a* is provided corresponding to the topline 2 described above, and the upper body 20 and the sole body 30 are inserted into the shell 10 through the mouth portion 10*a* at the time of manufacturing the shoe 1A, and the like.

As illustrated in FIG. 5, the internal space of the shell 10 is defined by the inner surface 11*a* of the bottom wall portion 11 and the inner peripheral surface 12*a* of the peripheral wall portion 12. The internal space is located across the forefoot portion R1, the midfoot portion R2, and the rearfoot portion R3.

The internal space of the shell 10 is divided into a lower space SP1 located in a lower portion in the up-down direction Z of the shoe 1A and an upper space SP2 located in an upper portion in the up-down direction Z of the shoe 1A. More specifically, the lower space SP1 is a space defined by the inner surface 11*a* of the bottom wall portion 11 and the inner peripheral surface 12*a* of the peripheral wall portion 12 at a portion adjacent to the bottom wall portion 11, and the upper space SP2 is a space defined by the inner peripheral surface 12*a* of a portion of the peripheral wall portion 12 located above the portion adjacent to the bottom wall portion 11 in the up-down direction Z.

That is, the lower space SP1 is located below the inside of the shell 10, and the sole body 30 is accommodated in the lower space SP1 as described above. On the other hand, the upper space SP2 is located above the inside of the shell 10, and the upper body 20 is accommodated in the upper space SP2. The upper space SP2 further includes the insertion space SP3 described above. The insertion space SP3 is defined by a space inside the upper body 20.

Here, in the shoe 1A according to the present embodiment, almost all of the portions of the shell 10 excluding the above-described mesh-like structure portion 10*b* are each formed of a three-dimensional mesh structure body. Here, the three-dimensional mesh structure body is formed by repeatedly arranging a plurality of predetermined unit structures in a manner of being adjacent to each other, and the three-dimensional mesh structure body includes those having a three-dimensional lattice structure and those having a three-dimensional wall structure.

The three-dimensional lattice structure is a structure in which a plurality of unit structures formed by connecting a plurality of columns extending in a predetermined direction is repeatedly arranged in a manner of being adjacent to each other. The unit structure of the three-dimensional lattice structure is not particularly limited, and for example, a rectangular parallelepiped lattice, a diamond lattice, an octahedral lattice, a double pyramid lattice, a dodecahedral lattice, or a lattice obtained by adding various columnar supports to these lattices can be used.

The three-dimensional wall structure is a structure in which a plurality of unit structures formed by walls whose outer shapes are defined by a pair of parallel curved surfaces or planes is repeatedly arranged in a manner of being adjacent to each other. The unit structure of the three-dimensional wall structure is not particularly limited, and for example, a Schwartz P structure, a gyroid structure, a Schwartz D structure, an octet structure, a cubic structure, a Kelvin structure, or a dodecahedron structure can be used.

Thus, in a case where the shell 10 includes a three-dimensional mesh structure body, as illustrated in FIGS. 1 to 4, an infinite number of holes 10*c* are formed in a manner of reaching the inner surface (that is, the inner surface 11*a* of the bottom wall portion 11 and the inner peripheral surface 12*a* of the peripheral wall portion 12) and the outer surface (that is, the outer surface 11*b* of the bottom wall portion 11 and the outer peripheral surface 12*b* of the peripheral wall portion 12) of the shell 10. The shell 10 having such a structure can be manufactured relatively easily, particularly by a three-dimensional additive manufacturing method to be described later.

By being configured in this manner, the shell 10 is provided with sufficient strength while also maintaining appropriate flexibility, thereby achieving both weight reduction and improved ventilation of the shoe 1A. In addition, since the upper body 20 accommodated in the internal space of the shell 10 can be visually recognized from the outside through the infinite number of holes 10*c*, the designability thereof is also improved.

Note that, in the shell 10 included in the shoe 1A according to the present embodiment, a three-dimensional mesh structure body having a three-dimensional lattice structure is used, but as described above, a three-dimensional mesh structure body having a three-dimensional wall structure may also be used. Furthermore, a portion of the shell 10 may have a three-dimensional lattice structure, and another portion of the shell 10 may have a three-dimensional wall structure.

As illustrated in FIGS. 1 to 5, the upper body 20 constitutes a portion in contact with the foot of the wearer of the shoe 1A, and is formed of a bag-shaped member provided with an opening portion 20*a*. The upper body 20 is formed of a member that can be flexibly deformed from the viewpoint of improving fit and ensuring excellent wearing comfort.

The upper body 20 includes a lower wall portion 21 configured to cover the sole of the foot of the wearer, and a side wall portion 22 configured to cover the peripheral surface of the foot of the wearer. The side wall portion 22 stands in a manner of continuously extending upward from the peripheral edge of the lower wall portion 21. The lower wall portion 21 extends along an upper surface (more specifically, a top surface 31*a* of a midsole 31 to be described later) to be described later of the sole body 30, and the side wall portion 22 extends along the inner peripheral surface 12*a* of the peripheral wall portion 12 of the shell 10.

As illustrated in FIG. 5, the lower wall portion 21 has an inner surface 21*a* and an outer surface 21*b* which are a pair of main surfaces. The inner surface 21*a* is located on the insertion space SP3 side, and the outer surface 21*b* is located on the sole body 30 side (that is, the bottom wall portion 11 side of the shell 10).

The side wall portion 22 has an inner peripheral surface 22*a* and an outer peripheral surface 22*b* which are a pair of main surfaces. The inner peripheral surface 22*a* is located on the insertion space SP3 side, and the outer peripheral surface 22*b* is located on the peripheral wall portion 12 side of the shell 10.

As illustrated in FIGS. 1 to 5, the opening portion 20*a* described above is provided at the upper end of the side wall portion 22. The opening portion 20*a* is located across the midfoot portion R2 and the rearfoot portion R3. The opening portion 20*a* corresponds to the topline 2 described above, and the foot of the wearer is inserted into the insertion space SP3 through the opening portion 20*a* at the time of wearing. The upper end portion of the side wall portion 22 of the portion defining the opening portion 20*a* is positioned in a manner of protruding upward in the up-down direction Z from the mouth portion 10*a* of the shell 10. Thus, it is possible to avoid direct contact of the shell 10 with the ankle of the wearer at the time of wearing, and it is possible to ensure excellent wearing comfort.

As illustrated in FIG. 5, the sole body 30 includes a midsole 31 as a shock absorber and a plate 32 as a resilient member. The midsole 31 and the plate 32 are laminated in the up-down direction Z in a manner that the midsole 31 is positioned above the plate 32.

The midsole 31 supports the sole of the foot of the wearer, and has a substantially plate-like flat shape. The midsole 31 has the top surface 31*a* and a bottom surface 31*b*, which are a pair of main surfaces, and side end surfaces connecting the top surface 31*a* and the bottom surface 31*b*. The midsole 31 is formed of an elastically deformable member having a predetermined thickness so as to obtain desired cushioning performance at the time of foot landing or the like.

Here, the top surface 31*a* of the midsole 31 may be configured to have an uneven shape corresponding to the sole shape of the foot of the wearer from the viewpoint of suppressing falling of the ankle of the wearer (so-called pronation) or crushing of the arch of the foot of the wearer, which may occur at the time of foot landing.

The plate 32 has a first main surface 32*a* and a second main surface 32*b*, which are a pair of main surfaces located in the thickness direction, and a peripheral end surface connecting the first main surface 32*a* and the second main surface 32*b*. The first main surface 32*a* faces upward in the up-down direction Z, and the second main surface 32*b* faces downward in the up-down direction Z. The plate 32 is formed of a hard member having a thickness smaller than that of the midsole 31 so as to obtain desired resilience performance at the time of take-off or the like.

As described above, the sole body 30 is configured by laminating the midsole 31 and the plate 32, and the bottom surface 31*b* of the midsole 31 is in contact with the first main surface 32*a* of the plate 32. The midsole 31 and the plate 32 may be joined by, for example, an adhesive, but from the viewpoint of reducing the amount of organic solvent used, it is preferable that the midsole 31 and the plate 32 are not joined.

The sole body 30 has an upper surface defined by the top surface 31*a* of the midsole 31, a lower surface defined by the second main surface 32*b* of the plate 32, and a peripheral surface defined by the side end surface of the midsole 31 and the peripheral end surface of the plate 32. The upper surface of the sole body 30 is covered with the lower wall portion 21 of the upper body 20. On the other hand, the peripheral surface and the lower surface of the sole body 30 face the peripheral wall portion 12 and the bottom wall portion 11 of the shell 10, respectively.

In the shoe 1A according to the present embodiment described above, the sole and the peripheral surface of the foot of the wearer are covered with the upper body 20. Therefore, in a state where the wearer wears the shoe 1A, the foot of the wearer is in contact with the soft upper body 20 that can be flexibly deformed, and the shell 10 does not directly contact the foot of the wearer, and thus, it is possible to obtain a shoe that can ensure excellent wearing comfort.

Furthermore, in the shoe 1A according to the present embodiment, the sole of the foot of the wearer is configured to be supported by the sole body 30 including the midsole 31 and the plate 32 via the upper body 20. Therefore, it is possible not only to suppress the impact at the time of foot landing from being applied to the foot of the wearer, but also to provide a shoe capable of obtaining a high propulsive force at the time of running.

Here, the upper body 20 does not necessarily have to entirely come into contact with the foot of the wearer, and the upper body 20 may be provided with a cutout or opening-shaped missing portion or the like as long as the wearing comfort is not impaired.

<B. Material of Each Member>

Next, a material of each member described above will be described. Note that the specific materials described below are merely examples, and are not limited thereto.

The shell 10 is made of an elastic material, preferably a resin material or a rubber material. More specifically, when the shell 10 is made of resin, it can be made of, for example, polyolefin resin, ethylene-vinyl acetate copolymer (EVA), polyamide thermoplastic elastomer (TPA, TPAE), thermoplastic polyurethane (TPU), or polyester thermoplastic elastomer (TPEE). On the other hand, when the shell 10 is made of rubber, it can be made of, for example, butadiene rubber.

The shell 10 can also be made of a polymer composition. In that case, examples of polymers contained in the polymer composition include olefin polymers such as olefin elastomers and olefin resins. Examples of olefin polymers include polyolefins such as polyethylene (e.g., linear low-density polyethylene (LLDPE), high-density polyethylene (HDPE), etc.), polypropylene, ethylene-propylene copolymers, propylene-1-hexene copolymers, propylene-4-methyl-1-pentene copolymers, propylene-1-butene copolymers, ethylene-1-hexene copolymers, ethylene-4-methyl-pentene copolymers, ethylene-1-butene copolymers, 1-butene-1-hexene copolymers, 1-butene-4-methyl-pentene, ethylene-methacrylic acid copolymers, ethylene-methyl methacrylate copolymers, ethylene-ethyl methacrylate copolymers, ethylene-butyl methacrylate copolymers, ethylene-methyl acrylate copolymers, ethylene-ethyl acrylate copolymers, ethylene-butyl acrylate copolymers, propylene-methacrylic acid copolymers, propylene-methyl methacrylate copolymers, propylene-ethyl methacrylate copolymers, propylene-butyl methacrylate copolymers, propylene-methyl acrylate copolymers, propylene-ethyl acrylate copolymers, propylene-butyl acrylate copolymers, ethylene-vinyl acetate copolymers (EVA), and propylene-vinyl acetate copolymers.

The above polymers may also be amide polymers such as amide elastomers and amide resins. Examples of the amide polymer include polyamide 6, polyamide 11, polyamide 12, polyamide 66, polyamide 610, and polyether block amide (PEBA).

Additionally, the above polymers may be ester polymers such as ester elastomers and ester resins. Examples of ester polymers include polyethylene terephthalate, polybutylene terephthalate.

Furthermore, the above polymers may be urethane polymers such as urethane elastomers and urethane resins. Examples of the urethane polymer include polyester polyurethanes and polyether polyurethanes, and particularly, urethane acrylates can be suitably used.

Moreover, the above polymers may be styrene polymers such as styrene elastomers and styrene resins. Examples of styrene elastomers include styrene-ethylene-butylene copolymers (SEB), styrene-butadiene-styrene copolymers (SBS), hydrogenated SBS (styrene-ethylene-butylene-styrene copolymers (SEBS)), styrene-isoprene-styrene copolymers (SIS), hydrogenated SIS (styrene-ethylene-propylene-styrene copolymers (SEPS)), styrene-isobutylene-styrene copolymers (SIBS), styrene-butadiene-styrene-butadiene (SBSB), and styrene-butadiene-styrene-butadiene-styrene (SBSBS). Examples of styrene resins include polystyrene, acrylonitrile-styrene resin (AS), acrylonitrile-butadiene-styrene resin (ABS).

Additionally, the above polymers may be, for example, acrylic polymers such as polymethyl methacrylate, urethane acrylic polymers, polyester acrylic polymers, polyether acrylic polymers, polycarbonate acrylic polymers, epoxy acrylic polymers, conjugated diene polymer acrylic polymers and the hydrogenated products thereof, urethane methacrylic polymers, polyester methacrylic polymers, polyether methacrylic polymers, polycarbonate methacrylic polymers, epoxy methacrylic polymers, conjugated diene polymer methacrylic polymers and the hydrogenated products thereof, polyvinyl chloride resins, silicone elastomers, butadiene rubber (BR), isoprene rubber (IR), chloroprene rubber (CR), natural rubber (NR), styrene-butadiene rubber (SBR), acrylonitrile-butadiene rubber (NBR), butyl rubber (IIR).

A method of manufacturing the shell 10 is not particularly limited, and the shell 10 can be manufactured by, for example, three-dimensional additive manufacturing. Here, even when the shell 10 is manufactured by three-dimensional additive manufacturing, the manufacturing method is not particularly limited, and a fused additive manufacturing method, a stereolithography manufacturing method, or a powder sintering additive manufacturing method can be suitably used.

The upper body 20 may be basically made of any material as long as it can be flexibly deformed, and preferably, a woven fabric, a knitted fabric, a nonwoven fabric, a synthetic leather, a resin, or the like is used. More specifically, the upper body 20 can be made of, for example, natural fibers such as cotton, hemp, and silk, and can be made of, for example, synthetic fibers made of a polyamide resin such as nylon, a polyester resin, a polyurethane resin, a polyvinyl alcohol resin such as vinylon, a polyacrylonitrile resin such as exlan and cashmilon, a polyvinyl chloride resin such as teviron and environ, a polypropylene resin such as pyrene, a polyethylene resin, a polystyrene resin, or the like. The upper body 20 can be made of, for example, rayon or cupra as regenerated fibers.

Particularly, as described later, if a woven fabric, a knitted fabric, a nonwoven fabric, or the like made of a synthetic fiber having heat shrinkability is used in a portion of the upper body 20, the upper body 20 that better fits the foot of the wearer can be obtained. Examples of the synthetic fiber having heat shrinkability include those containing a polyester resin, a polyurethane resin, or the like as a main component, and Hytrel (trademark), which is a kind of polyester resin, is particularly preferable.

That is, in a case where a portion of the upper body 20 is made of a woven fabric, a knitted fabric, a nonwoven fabric, or the like of a synthetic fiber having heat shrinkability, the upper body 20 is formed in a bag shape in advance, and heat treatment is performed in a state where a last is inserted into the upper body 20, and thus, heat shrinkage occurs due to heating, whereby a shape change occurs in a state where the portion of the upper body 20 is in close contact with the last, and the shape after the change is maintained. Therefore, by preparing a last corresponding to the shape of the wearer's foot and using it to shape the upper body 20 described above, the upper body 20 that fits the wearer's foot can be manufactured. Furthermore, by performing the heat treatment using the above-described last with the upper body 20 assembled into the shell 10, the upper body 20 will also fit the shell 10, thereby further improving the fit.

Here, a portion of the upper body 20 that can be made of a woven fabric, a knitted fabric, a nonwoven fabric, or the like of a synthetic fiber having heat shrinkability is the side wall portion 22 described above. The side wall portion 22 is a portion which is in contact with the peripheral surface of the foot of the wearer.

As the last described above, a last having a standard shape corresponding to the size of the foot of the wearer may be used, and if a last manufactured based on the shape data of the foot obtained by measuring the actual foot of the wearer is used, the fit of the manufactured shoe 1A to the foot of the wearer is remarkably improved.

The midsole 31 may be basically made of any material as long as it can be elastically deformed, and is preferably made of a member having an appropriate strength and excellent cushioning. From this viewpoint, the midsole 31 uses, for example, a resin foam material containing a resin material as the main component and a foaming agent and a crosslinking agent as secondary components. Alternatively, a rubber foam material containing a rubber material as a main component and a plasticizer, a foaming agent, a reinforcing agent, and a crosslinking agent as secondary components may be used.

Particularly preferably, the midsole 31 can be made of a foam material such as a polyolefin resin, an ethylene-vinyl acetate copolymer (EVA), a polyamide thermoplastic elastomer (TPA, TPAE), a thermoplastic polyurethane (TPU), or a polyester thermoplastic elastomer (TPEE). Note that the midsole 31 is not necessarily made of a foam material, and may be made of a non-foam material.

The material of the plate 32 is not particularly limited as long as the material of the plate 32 is harder than the material of the midsole 31. Examples of the material of the plate 32 include a fiber-reinforced resin using carbon fibers, glass fibers, aramid fibers, Dyneema fibers (registered trademark), ZYLON fibers (registered trademark), boron fibers, or the like as reinforcing fibers and an epoxy resin, a polyester resin, a phenol resin, a polyamide resin, a polypropylene resin, a polyethylene resin, a polyurethane resin, or the like as a base material, and a non-fiber-reinforced resin made of a polymer resin such as a urethane thermoplastic elastomer (TPU), an amide thermoplastic elastomer (TPA), or an ethylene-vinyl acetate copolymer (EVA).

<C. Configuration of Shell of Portion Corresponding to Vicinity of Medial and Lateral Malleoli of Foot of Wearer>

Figure 6:
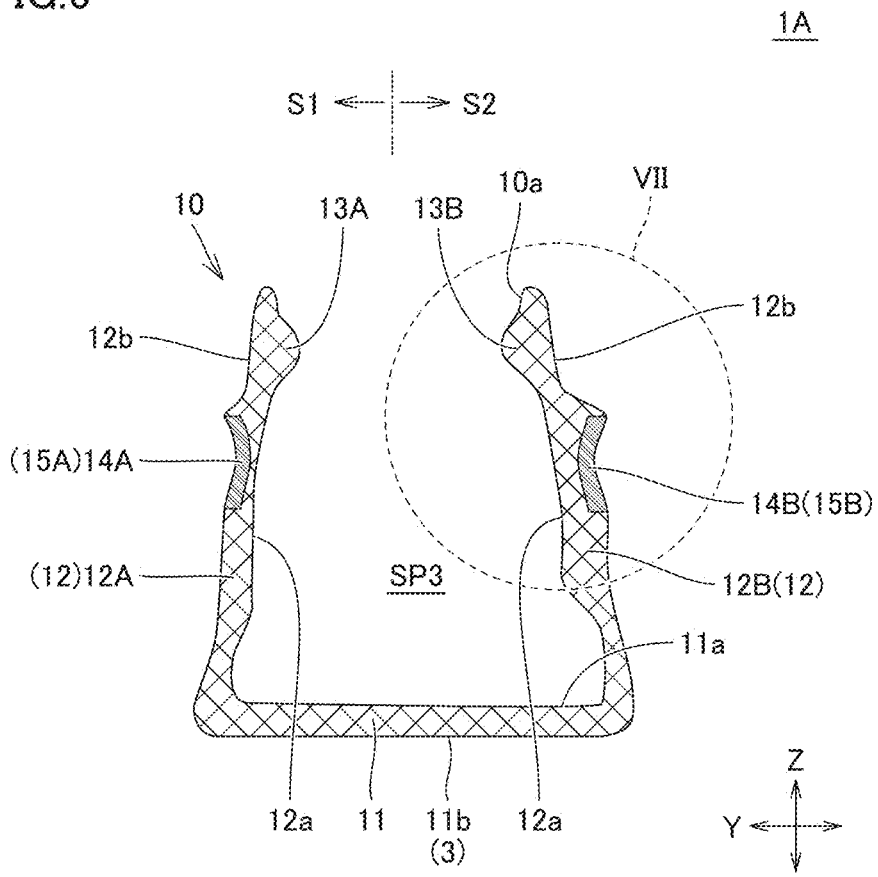
FIG. 6 is a schematic cross-sectional view of a shell included in the shoe illustrated in FIG. 1 taken along line VI-VI illustrated in FIG. 1.
Figure 7:
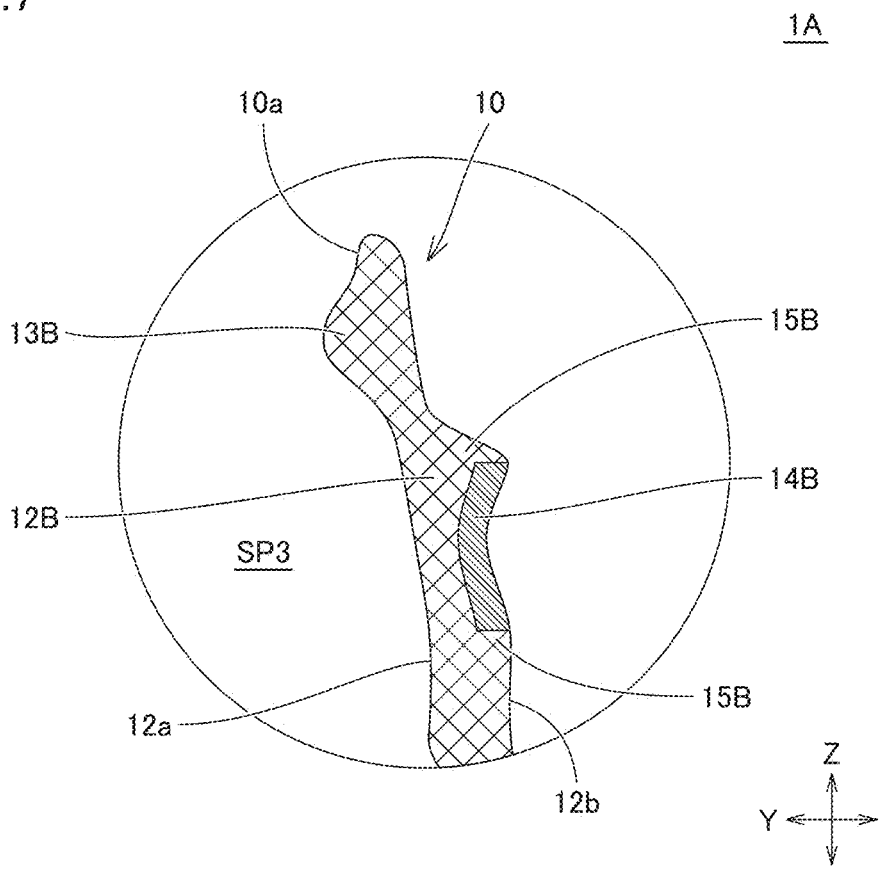
FIG. 7 is an enlarged view of a region VII illustrated in FIG. 6.

FIG. 6 is a schematic cross-sectional view of a shell included in the shoe illustrated in FIG. 1 taken along line VI-VI illustrated in FIG. 1. FIG. 7 is an enlarged view of a region VII illustrated in FIG. 6. Next, with reference to FIG. 6, FIG. 7 and FIGS. 1 to 5 described above, the configuration of the portion of the shell 10 included in the shoe 1A according to the present embodiment corresponding to the vicinity of the medial and lateral malleoli of the foot of the wearer will be described in detail.

As described above, the portion of the peripheral surface of the foot of the wearer, the portion being located behind the medial and lateral malleoli, is recessed more than the peripheral portion thereof, and a topline for inserting the foot of the wearer is located above the shell covering the portion, and thus, it is very difficult to enhance the dynamic fit in the portion. In order to solve this problem, as an example, it is conceivable to configure the portion of the shell by combining a plurality of members having different elastic moduli.

However, in the case of such a configuration, not only a problem that the manufacturing cost increases with an increase in the number of components and complication of assembly work occurs, but also use of an adhesive is unavoidable in order to fix a plurality of members to each other, and the adhesive contains an appropriate amount of an organic solvent, and thus, the configuration cannot be necessarily preferable from the viewpoint of environmental load.

Furthermore, in a case where the outer shell of the shoe is formed of the shell made of the elastic material as in the present embodiment, the shell is, for example, manufactured by three-dimensional additive manufacturing as described above, and thus, from the viewpoint of improving manufacturing efficiency, it is preferable that at least a portion of the shell corresponding to the vicinity of the medial and lateral malleoli of the foot of the wearer consists of a single member (that is, not a composite component obtained by combining a plurality of components, but one component), and it is necessary to improve the dynamic fit in the portion on the premise of these points.

In this regard, the shoe 1A according to the present embodiment improves the stationary fit by providing a medial foot side bulging portion 13A and a lateral foot side bulging portion 13B to be described later at the portions located behind the medial and lateral malleoli of the peripheral surface of the foot of the wearer, respectively, and further improves the dynamic fit by providing characteristic configurations to the medial foot side peripheral wall portion 12A and the lateral foot side peripheral wall portion 12B which are located around the portions where the medial foot side bulging portion 13A and the lateral foot side bulging portion 13B are provided.

As illustrated in FIG. 6, the medial foot side bulging portion 13A bulging toward the insertion space SP3 is provided at a position of the medial foot side peripheral wall portion 12A corresponding to a portion behind the medial malleolus point of the foot of the wearer (a region denoted by a reference sign A1 in FIG. 1, FIG. 2 and FIG. 4 corresponds to the position of the medial foot side peripheral wall portion 12A corresponding to the portion behind the medial malleolus point of the foot of the wearer). The medial foot side bulging portion 13A is formed of a three-dimensional mesh structure body.

The medial foot side bulging portion 13A is configured to have a shape along a recess existing in a portion located behind the medial malleolus of the peripheral surface of the foot of the wearer, thereby reducing a gap between the recess and the medial foot side peripheral wall portion 12A. Therefore, by providing the medial foot side bulging portion 13A in the medial foot side peripheral wall portion 12A, the fit at the time of wearing is improved.

Furthermore, since the medial foot side bulging portion 13A is formed of the three-dimensional mesh structure body as described above, the occupied volume ratio per unit volume is low, and the density is also low accordingly, and thus, the medial foot side bulging portion 13A functions as an easy-deformable portion. Therefore, when the medial foot side bulging portion 13A comes into contact with the foot of the wearer at the time of wearing, the medial foot side bulging portion 13A is compressed and deformed, thereby applying an appropriate pressure to the surface of the above-described recessed portion of the foot of the wearer by the reaction force of the compressive deformation, and thus, the stationary fit in the portion is enhanced.

Here, it is preferable that the medial foot side bulging portion 13A is configured in a manner that a surface shape of the medial foot side bulging portion 13A is smoothly curved in order to reduce application of excessive pressure to the foot of the wearer and improve foot contact, but the medial foot side bulging portion 13A may partially include a portion on a plane. The dimensions of the medial foot side bulging portion 13A are not particularly limited, but the height is preferably greater than or equal to 3 mm and less than or equal to 10 mm, and the width in the up-down direction Z is preferably greater than or equal to 5 mm and less than or equal to 30 mm. The compression rigidity of the medial foot side bulging portion 13A is preferably less than or equal to 1 MPa on condition that the compression rigidity of the medial foot side bulging portion 13A is lower than the compression rigidity of a medial foot side highly rigid portion 14A to be described later.

It is preferable that the three-dimensional mesh structure body formed of the three-dimensional lattice structure constituting the medial foot side bulging portion 13A has a structure in which the compression rigidity is low in the thickness direction of the medial foot side peripheral wall portion 12A of the portion where the medial foot side bulging portion 13A is provided, which is the compressive direction (the compression direction substantially coincides with the left-right direction Y), and the tensile rigidity is high in the direction orthogonal to the thickness direction. As an example of the structure, it is conceivable to adopt a three-dimensional lattice structure including a flat unit structure in which the dimension in the thickness direction of the medial foot side peripheral wall portion 12A of the unit structure included in the three-dimensional lattice structure is smaller than the dimension of the unit structure in the direction orthogonal to the thickness direction.

From the viewpoint of reducing the compression rigidity of the medial foot side bulging portion 13A, the columns of the three-dimensional lattice structure of the portion included in the medial foot side bulging portion 13A may be made thinner than the columns of the three-dimensional lattice structure of the portion of the medial foot side peripheral wall portion 12A not including the medial foot side bulging portion 13A. In this way, only the rigidity of the medial foot side bulging portion 13A can be locally suppressed low.

The medial foot side bulging portion 13A may be formed of a spot-shaped protrusion, or may be formed of a rib protrusion extending in a predetermined direction. Thus, it is preferable that in a case where the medial foot side bulging portion 13A is formed of the ridge protrusion extending in the predetermined direction, the extending direction is configured to follow the contour line of the medial malleolus of the foot of the wearer.

The lateral foot side bulging portion 13B bulging toward the insertion space SP3 is provided at a position of the lateral foot side peripheral wall portion 12B corresponding to a portion behind the lateral malleolus point of the foot of the wearer (a region denoted by a reference sign A2 in FIG. 1, FIG. 3 and FIG. 4 corresponds to the position of the lateral foot side peripheral wall portion 12B corresponding to the portion behind the lateral malleolus point of the foot of the wearer). The lateral foot side bulging portion 13B is formed of a three-dimensional mesh structure body.

The lateral foot side bulging portion 13B is configured to have a shape along a recess existing in a portion located behind the lateral malleolus of the peripheral surface of the foot of the wearer, thereby reducing a gap between the recess and the lateral foot side peripheral wall portion 12B. Therefore, by providing the lateral foot side bulging portion 13B in the lateral foot side peripheral wall portion 12B, the fit at the time of wearing is improved.

Furthermore, since the lateral foot side bulging portion 13B is formed of the three-dimensional mesh structure body as described above, the occupied volume ratio per unit volume is low, and the density is also low accordingly, and thus, the lateral foot side bulging portion 13B functions as an easy-deformable portion. Therefore, when the lateral foot side bulging portion 13B comes into contact with the foot of the wearer at the time of wearing, the lateral foot side bulging portion 13B is compressed and deformed, thereby applying an appropriate pressure to the surface of the above-described recessed portion of the foot of the wearer by the reaction force of the compressive deformation, and thus, the stationary fit in the portion is enhanced.

Here, it is preferable that the lateral foot side bulging portion 13B is configured in a manner that a surface shape of the lateral foot side bulging portion 13B is smoothly curved in order to reduce application of excessive pressure to the foot of the wearer and improve foot contact, but the lateral foot side bulging portion 13B may partially include a portion on a plane. The dimensions of the lateral foot side bulging portion 13B are not particularly limited, but the height is preferably greater than or equal to 3 mm and less than or equal to 10 mm, and the width in the up-down direction Z is preferably greater than or equal to 5 mm and less than or equal to 30 mm. The compression rigidity of the lateral foot side bulging portion 13B is preferably less than or equal to 1 MPa on condition that the compression rigidity of the lateral foot side bulging portion 13B is lower than the compression rigidity of a lateral foot side highly rigid portion 14B to be described later.

It is preferable that the three-dimensional mesh structure body formed of the three-dimensional lattice structure constituting the lateral foot side bulging portion 13B has a structure in which the compression rigidity is low in the thickness direction of the lateral foot side peripheral wall portion 12B of the portion where the lateral foot side bulging portion 13B is provided, which is the compressive direction (the compression direction substantially coincides with the left-right direction Y), and the tensile rigidity is high in the direction orthogonal to the thickness direction. As an example of the structure, it is conceivable to adopt a three-dimensional lattice structure including a flat unit structure in which the dimension in the thickness direction of the lateral foot side peripheral wall portion 12B of the unit structure included in the three-dimensional lattice structure is smaller than the dimension of the unit structure in the direction orthogonal to the thickness direction.

From the viewpoint of reducing the compression rigidity of the lateral foot side bulging portion 13B, the columns of the three-dimensional lattice structure of the portion included in the lateral foot side bulging portion 13B may be made thinner than the columns of the three-dimensional lattice structure of the portion of the lateral foot side peripheral wall portion 12B not including the lateral foot side bulging portion 13B. In this way, only the rigidity of the lateral foot side bulging portion 13B can be locally suppressed low.

The lateral foot side bulging portion 13B may be formed of a spot-shaped protrusion, or may be formed of a rib protrusion extending in a predetermined direction. Thus, it is preferable that in a case where the lateral foot side bulging portion 13B is formed of the ridge protrusion extending in the predetermined direction, the extending direction is configured to follow the contour line of the lateral malleolus of the foot of the wearer.

On the other hand, the medial foot side highly rigid portion 14A is provided at a position below the portion of the medial foot side peripheral wall portion 12A where the medial foot side bulging portion 13A is provided in the up-down direction Z. The medial foot side highly rigid portion 14A is formed of a solid structure, and has a belt-like shape extending in the front-rear direction X (particularly, see FIG. 2).

The medial foot side highly rigid portion 14A is a portion for enhancing the bending rigidity of the medial foot side peripheral wall portion 12A (particularly, a portion of the medial foot side peripheral wall portion 12A where the medial foot side bulging portion 13A is provided). That is, the medial foot side highly rigid portion 14A formed of a solid structure has a high occupied volume ratio per unit volume and accordingly has a high density, and thus functions as a hard-deformable portion. Therefore, not only at the time of the low-strength exercise but also at the time of the high-strength exercise, the medial foot side highly rigid portion 14A suppresses the outward (that is, toward the side opposite to the insertion space SP3) collapse of the medial foot side peripheral wall portion 12A along with the movement of the foot of the wearer (so-called foot bending motion or the like).

Therefore, since the above-described collapse of the medial foot side peripheral wall portion 12A can be suppressed, the medial foot side bulging portion 13A can be prevented from separating from the surface of the foot of the wearer, and as a result, the fit of the medial foot side bulging portion 13A with respect to the surface of the above-described recessed portion of the foot of the wearer can be maintained, and the dynamic fit in the portion can be secured.

As described above, by forming the medial foot side highly rigid portion 14A into the belt-like shape extending in the front-rear direction X, as compared with the case where the medial foot side highly rigid portion 14A is provided only in the portion of the medial foot side peripheral wall portion 12A where the medial foot side bulging portion 13A is provided, the bending rigidity of the medial foot side peripheral wall portion 12A in the portion where the medial foot side bulging portion 13A is provided can be enhanced while the size of the medial foot side highly rigid portion 14A is further suppressed to be small, and the dynamic fit can be improved while weight reduction is achieved.

The lateral foot side highly rigid portion 14B is provided at a position below the portion of the lateral foot side peripheral wall portion 12B where the lateral foot side bulging portion 13B is provided in the up-down direction Z. The lateral foot side highly rigid portion 14B is formed of a solid structure, and has a belt-like shape extending in the front-rear direction X (particularly, see FIG. 3).

The lateral foot side highly rigid portion 14B is a portion for enhancing the bending rigidity of the lateral foot side peripheral wall portion 12B (particularly, a portion of the lateral foot side peripheral wall portion 12B where the lateral foot side bulging portion 13B is provided). That is, the lateral foot side highly rigid portion 14B formed of a solid structure has a high occupied volume ratio per unit volume and accordingly has a high density, and thus functions as a hard-deformable portion. Therefore, not only at the time of the low-strength exercise but also at the time of the high-strength exercise, the lateral foot side highly rigid portion 14B suppresses the outward (that is, toward the side opposite to the insertion space SP3) collapse of the lateral foot side peripheral wall portion 12B along with the movement of the foot of the wearer (so-called foot bending motion or the like).

Therefore, since the above-described collapse of the lateral foot side peripheral wall portion 12B can be suppressed, the lateral foot side bulging portion 13B can be prevented from separating from the surface of the foot of the wearer, and as a result, the fit of the lateral foot side bulging portion 13B with respect to the surface of the above-described recessed portion of the foot of the wearer can be maintained, and the dynamic fit in the portion can be secured.

As described above, by forming the lateral foot side highly rigid portion 14B into the belt-like shape extending in the front-rear direction X, as compared with the case where the lateral foot side highly rigid portion 14B is provided only in the portion of the lateral foot side peripheral wall portion 12B where the lateral foot side bulging portion 13B is provided, the bending rigidity of the lateral foot side peripheral wall portion 12B in the portion where the lateral foot side bulging portion 13B is provided can be enhanced while the size of the lateral foot side highly rigid portion 14B is further suppressed to be small, and the dynamic fit can be improved while weight reduction is achieved.

Therefore, by adopting the shoe 1A according to the present embodiment, it is possible to improve the stationary fit and the dynamic fit of the shell 10 with respect to the foot at the position behind the malleolus of the foot of the wearer in the shoe including the flexible shell 10 made of the elastic material. Particularly, the rear end portion of the shoe 1A provided with the medial foot side bulging portion 13A and the lateral foot side bulging portion 13B described above is a portion that, in a case where the fit is poor, causes the foot of the wearer to move to the front, back, left, and right inside the shoe, thereby causing fatigue or foot injury to the wearer, and is a portion that causes the shoe to fall off from the foot of the wearer, and thus, the effect of the shoe 1A is highly significant.

In addition, in the shoe 1A according to the present embodiment, as described above, the medial foot side bulging portion 13A and the lateral foot side bulging portion 13B are provided in the shell 10, and thus, it is easy to maintain the state in which the medial foot side bulging portion 13A and the lateral foot side bulging portion 13B are in contact with the recess of the portion located behind the malleolus of the peripheral surface of the foot of the wearer not only at the time of being stationary but also at the time of walking or running. Therefore, even when the foot moves (bending motion or the like), a gap between the shoe 1A and the recess in the portion located behind the malleolus of the peripheral surface of the foot of the wearer is less likely to occur, and it is possible to provide a comfortable shoe capable of suppressing the occurrence of shoe rubbing.

In addition, in the shoe 1A according to the present embodiment, almost the entire shell 10 is formed of the three-dimensional mesh structure body, but as described above, particularly, the medial foot side bulging portion 13A and the lateral foot side bulging portion 13B are each formed of the three-dimensional mesh structure body, and thus, the ventilation in the portion is improved, and as a result, the accumulation of frictional heat in the portion, which may cause shoe rubbing, can also be reduced, thereby further contributing to the provision of a comfortable shoe.

Since both the medial foot side bulging portion 13A and the lateral foot side bulging portion 13B are covered with the side wall portion 22 of the upper body 20, even in a case of adopting the above configuration, the foot contact is not deteriorated, and a shoe with excellent wearing comfort can be obtained. And even in a case where the medial foot side bulging portion 13A and the lateral foot side bulging portion 13B are exposed without being covered with the upper body 20, the wearing comfort is not extremely lowered.

Here, as illustrated in FIGS. 2 and 3, the medial foot side highly rigid portion 14A and the lateral foot side highly rigid portion 14B extend from the front end of the shoe 1A to the rear end of the shoe 1A, and particularly, in a portion on the rear end side of the shoe 1A (that is, from the midfoot portion R2 to the rearfoot portion R3), the medial foot side highly rigid portion 14A and the lateral foot side highly rigid portion 14B are positioned to be inclined downward toward the front side in the front-rear direction X of the shoe 1A.

Thus, by providing the medial foot side highly rigid portion 14A and the lateral foot side highly rigid portion 14B in a manner of extending from the front end of the shoe 1A to the rear end of the shoe 1A, it is possible to enhance the bending rigidity of the medial foot side peripheral wall portion 12A and the lateral foot side peripheral wall portion 12B over the entire shoe 1A in the front-rear direction X as well as the bending rigidity of the rear end side portion of the shoe 1A where the medial foot side bulging portion 13A and the lateral foot side bulging portion 13B are provided, and it is possible not only to enhance the dynamic fit but also to suppress excessive pronation at the time of foot landing.

More specifically, by providing the medial foot side highly rigid portion 14A and the lateral foot side highly rigid portion 14B to be inclined downward toward the front side in the front-rear direction X of the shoe 1A, in the forefoot portion R1 and the midfoot portion R2, the medial foot side highly rigid portion 14A and the lateral foot side highly rigid portion 14B are disposed at positions near the lower end in the up-down direction Z of the insertion space SP3 described above as compared with the rearfoot portion R3. Thus, by providing the medial foot side highly rigid portion 14A and the lateral foot side highly rigid portion 14B at positions near the lower end in the up-down direction Z of the insertion space SP3, it is possible to suppress the above-described collapse of the medial foot side peripheral wall portion 12A and the lateral foot side peripheral wall portion 12B from lower positions in the up-down direction Z as compared with the case where the medial foot side highly rigid portion 14A and the lateral foot side highly rigid portion 14B are provided at upper positions in the up-down direction Z.

Therefore, with such a configuration, the collapse of the medial foot side peripheral wall portion 12A and the lateral foot side peripheral wall portion 12B can be more reliably suppressed not only in the forefoot portion R1 and the midfoot portion R2 but also in the rearfoot portion R3. Therefore, particularly, in the forefoot portion R1 and the midfoot portion R2, the stability at the time of foot landing is improved, and in the rearfoot portion R3, in addition to the stability at the time of foot landing, excessive pronation at the time of foot landing can be suppressed.

Note that, in a case where the medial foot side highly rigid portion 14A and the lateral foot side highly rigid portion 14B are provided at a position further below the lower end in the up-down direction Z of the insertion space SP3 described above, the starting point of the collapse of the medial foot side peripheral wall portion 12A and the lateral foot side peripheral wall portion 12B of the shell 10 moves to a position further below the sole of the wearer, and the collapse of the medial foot side peripheral wall portion 12A and the lateral foot side peripheral wall portion 12B is likely to occur conversely. Therefore, the lower limit of the position where the medial foot side highly rigid portion 14A and the lateral foot side highly rigid portion 14B are provided is desirably a position corresponding to the lower end in the up-down direction Z of the insertion space SP3.

Furthermore, as described above, in the portion on the rear end side of the shoe 1A, the medial foot side highly rigid portion 14A and the lateral foot side highly rigid portion 14B are provided to be inclined downward toward the front side in the front-rear direction X of the shoe 1A, and thus, it is difficult for the medial foot side highly rigid portion 14A and the lateral foot side highly rigid portion 14B to inhibit the forward propagation of the load, which is applied to the shoe 1A from the foot of the wearer, at the time of foot landing, and thereby, the propagation direction of the load can be matched with the direction in which the force flows during the foot landing action in the order of the rearfoot portion R3, through the midfoot portion R2, and then to the forefoot portion R1, and the energy loss during running and walking can be suppressed.

In addition, by providing the medial foot side highly rigid portion 14A and the lateral foot side highly rigid portion 14B at the forefoot portion R1 (particularly, the front end of the shoe 1A), the rigidity of the shell 10 at the toe portion is improved, and thus, the effect of improving the wear resistance of the shell 10 can be obtained, and as a result, the effect of increasing the durability of the shoe 1A can also be obtained.

As illustrated in FIGS. 2 to 4, the medial foot side highly rigid portion 14A and the lateral foot side highly rigid portion 14B are configured such that the width of each in the up-down direction is enlarged in the rearfoot portion R3. With such a configuration, the rigidity of the peripheral wall portion 12 in the rearfoot portion R3 can be particularly enhanced, and thus, the dynamic fit in the portion can be further improved, and the shoe 1A can be more reliably prevented from falling off the foot of the wearer during high-strength exercise.

The medial foot side highly rigid portion 14A and the lateral foot side highly rigid portion 14B are not necessarily each formed of a solid structure, and may be each formed of a porous structure having voids therein as long as the medial foot side highly rigid portion 14A and the lateral foot side highly rigid portion 14B have higher rigidity than the medial foot side bulging portion 13A and the lateral foot side bulging portion 13B. That is, as long as the medial foot side highly rigid portion 14A and the lateral foot side highly rigid portion 14B are configured to have higher rigidity than the medial foot side bulging portion 13A and the lateral foot side bulging portion 13B, respectively, it is possible to provide a shoe in which the stationary fit and the dynamic fit of the shell 10 with respect to the foot are improved at the position behind the malleolus of the foot of the wearer.

In the shoe 1A according to the present embodiment, as described above, the medial foot side highly rigid portion 14A and the lateral foot side highly rigid portion 14B are configured to reach not only the rearfoot portion R3 but also the forefoot portion R1 and the midfoot portion R2, and the medial foot side highly rigid portion 14A and the lateral foot side highly rigid portion 14B are provided to be inclined downward toward the front side in the front-rear direction X of the shoe 1A. However, the medial foot side highly rigid portion 14A and the lateral foot side highly rigid portion 14B may be provided only in the rearfoot portion R3.

Here, it is preferable that, when the medial foot side highly rigid portion 14A and the lateral foot side highly rigid portion 14B are provided only in the rearfoot portion R3, the medial foot side highly rigid portion 14A and the lateral foot side highly rigid portion 14B are connected to each other via the rear end of the shoe 1A. With such a configuration, the medial foot side highly rigid portion 14A and the lateral foot side highly rigid portion 14B connected to each other function as a kind of stopper that suppresses the collapse of each other, and thus, the excessive collapse of the medial foot side peripheral wall portion 12A and the lateral foot side peripheral wall portion 12B in the rearfoot portion R3 can be effectively suppressed.

As illustrated in FIG. 6, in the shoe 1A according to the present embodiment, the medial foot side highly rigid portion 14A is provided along the medial foot side rib portion 15A provided on the medial foot side peripheral wall portion 12A, and the lateral foot side highly rigid portion 14B is provided along the lateral foot side rib portion 15B provided on the lateral foot side peripheral wall portion 12B. Hereinafter, this point will be described with reference to FIG. 7 focusing on the lateral foot side highly rigid portion 14B and the lateral foot side rib portion 15B, and the medial foot side highly rigid portion 14A and the medial foot side rib portion 15A are similarly configured.

As illustrated in FIG. 7, two lateral foot side rib portions 15B protruding toward the side opposite to the insertion space SP3 side are provided at positions below the portion of the lateral foot side peripheral wall portion 12B where the lateral foot side bulging portion 13B is provided in the up-down direction Z. These two lateral foot side rib portions 15B extend in parallel with each other in the front-rear direction X.

These two lateral foot side rib portions 15B are provided corresponding to the portion of the lateral foot side peripheral wall portion 12B where the lateral foot side highly rigid portion 14B described above is provided. Therefore, as illustrated in FIG. 3, the lateral foot side rib portion 15B, similarly to the lateral foot side highly rigid portion 14B, extends from the front end of the shoe 1A to the rear end of the shoe 1A, and particularly, in a portion on the rear end side of the shoe 1A (that is, from the midfoot portion R2 to the rearfoot portion R3), the lateral foot side rib portion 15B is positioned to be inclined downward toward the front side in the front-rear direction X of the shoe 1A. In other words, the lateral foot side highly rigid portion 14B is provided along these two lateral foot side rib portions 15B.

The lateral foot side highly rigid portion 14B is located on the outer surface (that is, the outer peripheral surface 12*b*) of the portion corresponding to the lateral foot side rib portion 15B of the lateral foot side peripheral wall portion 12B. More specifically, the end surface of the lateral foot side highly rigid portion 14B located on the insertion space SP3 side is covered with the three-dimensional mesh structure body constituting the lateral foot side peripheral wall portion 12B, and the end surface of the lateral foot side highly rigid portion 14B located on the side opposite to the insertion space SP3 is exposed on the outer peripheral surface 12*b* of the lateral foot side peripheral wall portion 12B.

With such a configuration, it is possible to provide the lateral foot side highly rigid portion 14B having a necessary thickness by increasing the thickness of the lateral foot side peripheral wall portion 12B of the portion where the lateral foot side highly rigid portion 14B is provided, and it is possible to position the three-dimensional mesh structure body as the easy-deformable portion between the lateral foot side highly rigid portion 14B and the foot of the wearer in the portion where the lateral foot side highly rigid portion 14B is provided, and thus, it is possible to provide a shoe having excellent foot contact.

Furthermore, by providing the two lateral foot side rib portions 15B extending in parallel in this manner, a concave portion is provided between the two lateral foot side rib portions 15B, and if the lateral foot side highly rigid portion 14B is provided in the concave portion, it is possible to enhance the cross-sectional secondary moment of the lateral foot side highly rigid portion 14B as compared with the size thereof, and it is possible to effectively enhance the rigidity of the lateral foot side peripheral wall portion 12B while achieving weight reduction.

(D. Another Aspect of Highly Rigid Portion)

Figure 8A:
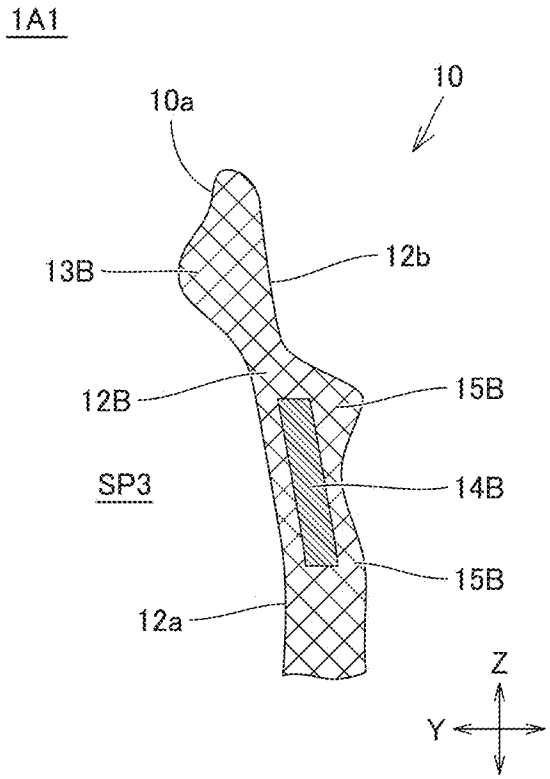
FIG. 8A is a schematic cross-sectional view illustrating a first configuration example which is another aspect of a highly rigid portion provided in the shell included in the shoe illustrated in FIG. 1.
Figure 8B:
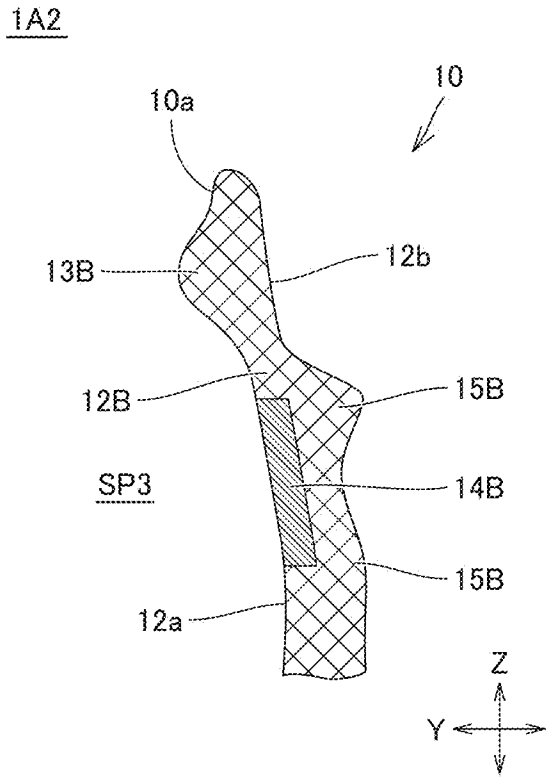
FIG. 8B is a schematic cross-sectional view illustrating a second configuration example which is another aspect of the highly rigid portion provided in the shell included in the shoe illustrated in FIG. 1.
Figure 8C:
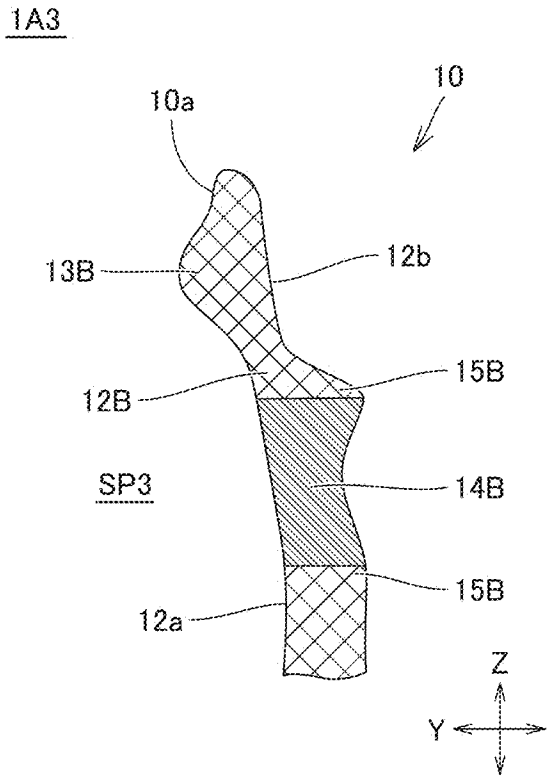
FIG. 8C is a schematic cross-sectional view illustrating a third configuration example which is another aspect of the highly rigid portion provided in the shell included in the shoe illustrated in FIG. 1.

FIGS. 8A to 8C are schematic cross-sectional views illustrating a first to a third configuration examples, each of which is another aspect of the highly rigid portion provided in the shell included in the shoe illustrated in FIG. 1. Hereinafter, the first to the third configuration examples, each of which is another aspect of the highly rigid portion according to the present embodiment, will be described with reference to FIGS. 8A to 8C. Hereinafter, the description will be given focusing on the lateral foot side highly rigid portion 14B, and the medial foot side highly rigid portion 14A can also be configured in the same manner.

As illustrated in FIG. 8A, in a shoe 1A1 according to the first configuration example, the lateral foot side highly rigid portion 14B is embedded in the lateral foot side peripheral wall portion 12B. That is, the end surface of the lateral foot side highly rigid portion 14B located on the insertion space SP3 side is covered with the three-dimensional mesh structure body constituting the lateral foot side peripheral wall portion 12B, and the end surface of the lateral foot side highly rigid portion 14B located on the side opposite to the insertion space SP3 is also covered with the three-dimensional mesh structure body constituting the lateral foot side peripheral wall portion 12B.

When configured in such a manner, it is also possible to provide a shoe in which the stationary fit and the dynamic fit of the shell 10 with respect to the foot are improved at the position behind the malleolus of the foot of the wearer. In addition, when configured in such a manner, in the portion of the lateral foot side peripheral wall portion 12B where the lateral foot side bulging portion 13B is provided, it is possible to suppress the occurrence of excessive compressive deformation in the three-dimensional mesh structure body located in the portion other than the portion where the lateral foot side highly rigid portion 14B is provided, and it is possible to more effectively suppress the collapse of the lateral foot side highly rigid portion 14B described above.

As illustrated in FIG. 8B, in a shoe 1A2 according to the second configuration example, the lateral foot side highly rigid portion 14B is located on the inner surface (that is, the inner peripheral surface 12*a*) of the lateral foot side peripheral wall portion 12B. More specifically, the end surface of the lateral foot side highly rigid portion 14B located on the insertion space SP3 side is exposed on the inner peripheral surface 12*a* of the lateral foot side peripheral wall portion 12B, and the end surface of the lateral foot side highly rigid portion 14B located on the side opposite to the insertion space SP3 is covered with the three-dimensional mesh structure body constituting the lateral foot side peripheral wall portion 12B.

When configured in such a manner, it is also possible to provide a shoe in which the stationary fit and the dynamic fit of the shell 10 with respect to the foot are improved at the position behind the malleolus of the foot of the wearer. In addition, when configured in such a manner, the shape retainability of the shell 10 is improved in the portion where the lateral foot side highly rigid portion 14B of the inner peripheral surface 12*a* of the lateral foot side peripheral wall portion 12B is disposed, thereby suppressing unintended deformation of the shell 10.

As illustrated in FIG. 8C, in a shoe 1A3 according to the third configuration example, the lateral foot side highly rigid portion 14B is provided over the thickness direction of the lateral foot side peripheral wall portion 12B to be located on both the inner surface (that is, the inner peripheral surface 12*a*) and the outer surface (that is, the outer peripheral surface 12*b*) of the lateral foot side peripheral wall portion 12B. Thus, the end surface of the lateral foot side highly rigid portion 14B located on the insertion space SP3 side is exposed on the inner peripheral surface 12*a* of the lateral foot side peripheral wall portion 12B, and the end surface of the lateral foot side highly rigid portion 14B located on the side opposite to the insertion space SP3 is also exposed on the outer peripheral surface 12*b* of the lateral foot side peripheral wall portion 12B.

When configured in such a manner, it is also possible to provide a shoe in which the stationary fit and the dynamic fit of the shell 10 with respect to the foot are improved at the position behind the malleolus of the foot of the wearer. In addition, when configured in such a manner, the shape retainability of the shell 10 is improved in the portion where the lateral foot side highly rigid portion 14B is disposed, thereby suppressing unintended deformation of the shell 10.

Alternatively, the lateral foot side highly rigid portion may be located on both the inner surface and the outer surface of the lateral foot side peripheral wall portion, and the lateral foot side highly rigid portion provided on the inner surface of the lateral foot side peripheral wall portion and the lateral foot side highly rigid portion provided on the outer surface of the lateral foot side peripheral wall portion may be provided only on the surface layers of the inner surface and the outer surface, respectively (that is, the three-dimensional mesh structure body is located between the lateral foot side highly rigid portion provided on the inner surface of the lateral foot side peripheral wall portion and the lateral foot side highly rigid portion provided on the outer surface of the lateral foot side peripheral wall portion). When configured in such a manner, it is possible to enhance the rigidity of the lateral foot side peripheral wall portion of the portion where the lateral foot side highly rigid portion is provided while achieving weight reduction.

<E. Secondary Effects During Three-Dimensional Additive Manufacturing of Shell>

Figure 9:
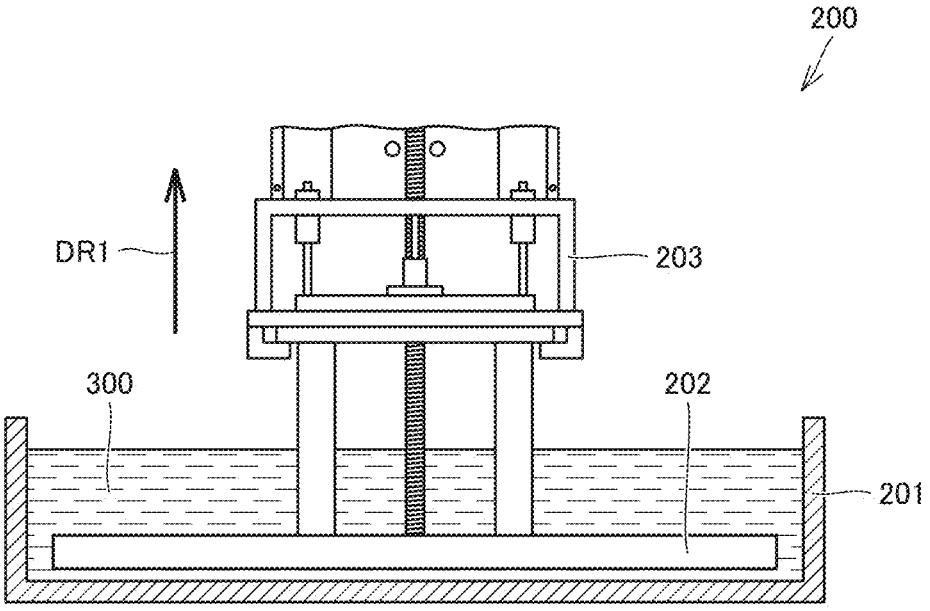
FIG. 9 is a schematic view for describing three-dimensional additive manufacturing of the shell included in the shoe illustrated in FIG. 1.
Figure 10:
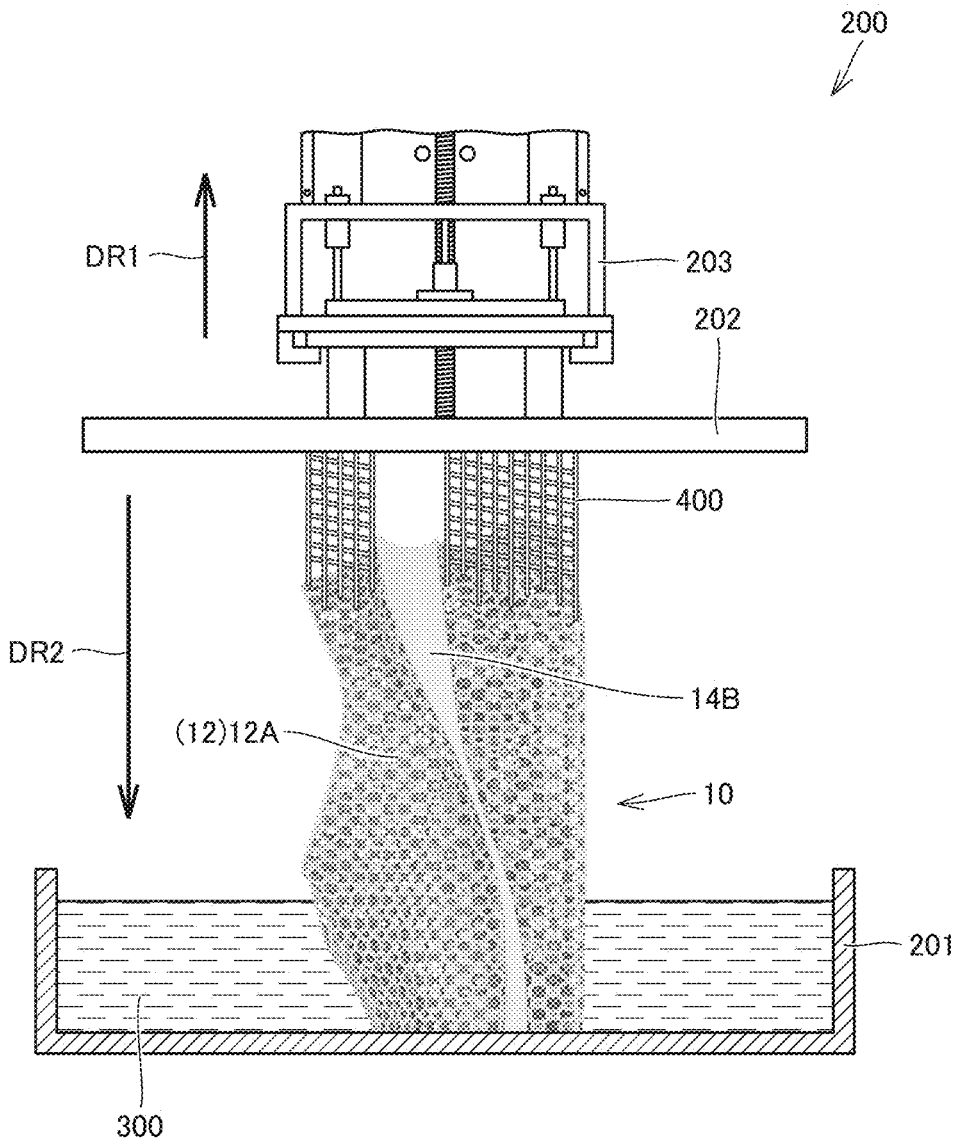
FIG. 10 is a schematic view for describing three-dimensional additive manufacturing of the shell included in the shoe illustrated in FIG. 1.
Figure 11:
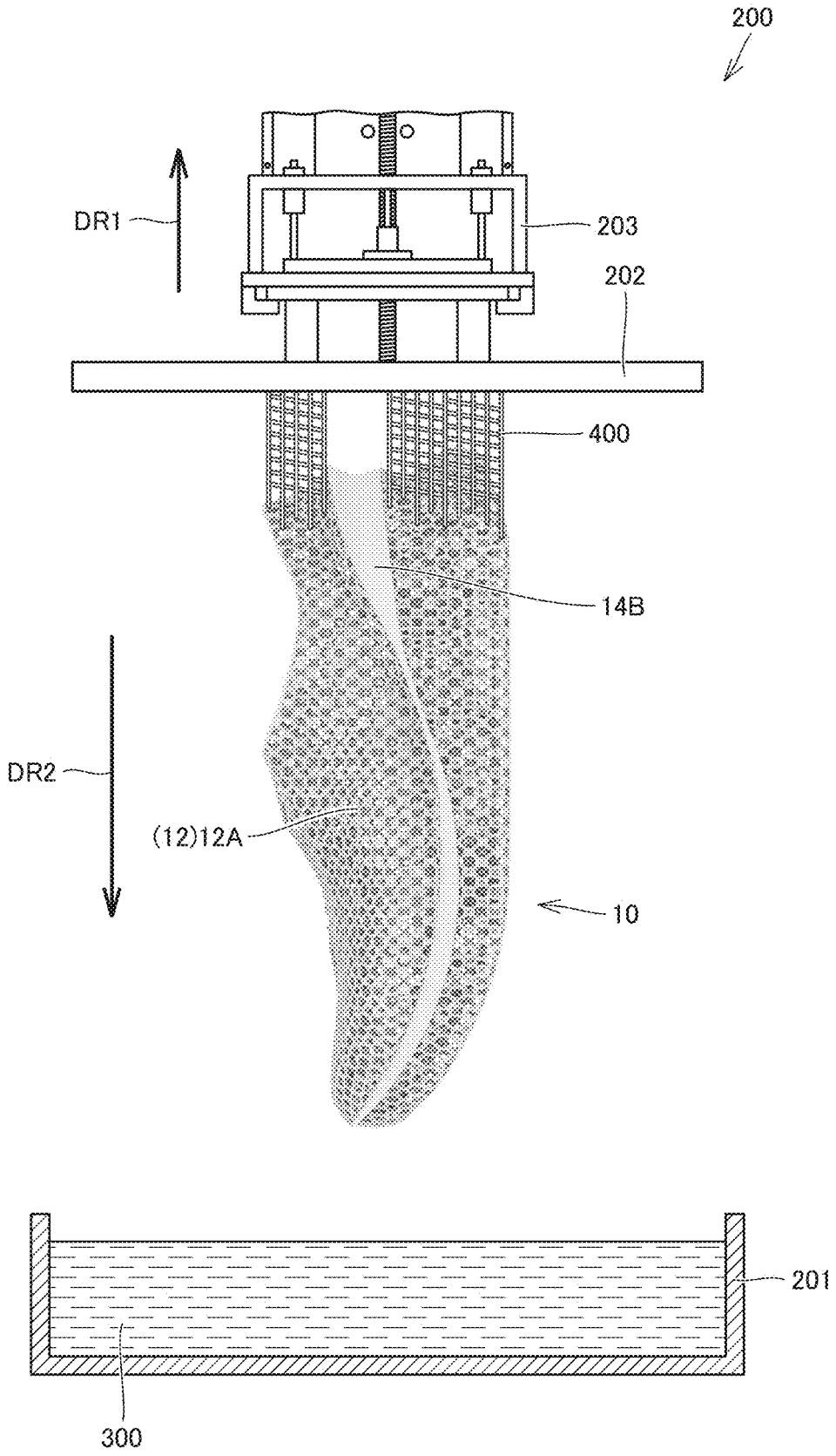
FIG. 11 is a schematic view for describing three-dimensional additive manufacturing of the shell included in the shoe illustrated in FIG. 1.

FIGS. 9 to 11 are schematic views for describing three-dimensional additive manufacturing of the shell included in the shoe illustrated in FIG. 1, and illustrate a state at the start, a state at an intermediate stage, and a state at the end of the manufacturing, respectively. Next, with reference to FIGS. 9 to 11, three-dimensional additive manufacturing of the shell 10 included in the shoe 1A according to the present embodiment will be described, and secondary effects obtained at the time of three-dimensional additive manufacturing of the shell 10 by adopting the above configuration will be described.

For the three-dimensional additive manufacturing of the shell 10, for example, a three-dimensional additive manufacturing apparatus 200 as illustrated in FIGS. 9 to 11 is used. The three-dimensional additive manufacturing apparatus 200 performs three-dimensional additive manufacturing based on a vat photopolymerization method. The three-dimensional additive manufacturing method based on the vat photopolymerization method is a manufacturing method in which an additively manufactured product having a desired shape is manufactured by sequentially laminating cured portions by irradiating a photocurable liquid polymer material which can be cured by light having a specific wavelength as a main raw material with light having the specific wavelength. As light of the specific wavelength, for example, ultraviolet is used, and in that case, ultraviolet-curable polymer is used as the main raw material. Note that the above-described liquid polymer material as the main raw material is not limited to single-component liquids and may also include two-component liquids, etc.

As illustrated in FIGS. 9 to 11, the three-dimensional additive manufacturing apparatus 200 includes a light source (not illustrated), a reservoir 201, a platform 202, and an elevating mechanism 203. The reservoir 201 is a portion that stores a liquid polymer material 300 as a raw material, and the platform 202 is used to hold and move the additively manufactured product. The elevating mechanism 203 moves the platform 202 in the up-down direction.

As illustrated in FIG. 9, in the three-dimensional additive manufacturing apparatus 200, first, the platform 202 is moved by the elevating mechanism 203 to bring the lower surface of the platform 202 into a state of being disposed in the vicinity of the inner bottom surface of the reservoir 201, and in this state, light of a specific wavelength emitted from the light source is irradiated to the liquid polymer material 300 positioned between the lower surface of the platform 202 and the inner bottom surface of the reservoir 201 to draw a predetermined pattern, whereby exposure is performed. Thus, the liquid polymer material 300 located between the lower surface of the platform 202 and the inner bottom surface of the reservoir 201 is cured in layers in a state of being attached to the inner bottom surface of the reservoir 201 and the lower surface of the platform 202, and a first cured layer is formed.

Next, the platform 202 is moved upward (that is, in the direction of an arrow DR1 in the drawing) by a predetermined amount by the elevating mechanism 203, whereby the first cured layer is peeled off from the inner bottom surface of the reservoir 201, and in this state, light of a specific wavelength emitted from the light source is irradiated to the liquid polymer material 300 positioned between the lower surface of the platform 202 and the inner bottom surface of the reservoir 201 to draw a predetermined pattern, whereby exposure is performed. Thus, the liquid polymer material 300 located between the lower surface of the first cured layer and the inner bottom surface of the reservoir 201 is cured in layers in a state of being attached to the lower surface of the first cured layer and the lower surface of the platform 202, and a second cured layer is formed.

By repeating steps similar to the step for forming the second cured layer (i.e., the movement step of the platform 202 and the exposure step of the liquid polymer material 300), as shown in FIG. 10, a plurality of cured layers is sequentially laminated downward (i.e., in the direction of an arrow DR2 in the drawing), thereby advancing the manufacturing of the shell 10.

Then, as illustrated in FIG. 11, after all the portions of the shell 10 are manufactured, the platform 202 is further lifted up by the elevating mechanism 203, and the shell 10 is pulled away from the liquid polymer material 300 stored in the reservoir 201 and taken out from the three-dimensional additive manufacturing apparatus 200.

Here, in the example of the three-dimensional additive manufacturing of the shell 10 illustrated in FIGS. 9 to 11, the shell 10 is configured such that the manufacturing of the shell 10 proceeds from the rear end side toward the front end side. In this way, the footprint necessary for the manufacturing of the shell 10 on the platform 202 becomes relatively small, and thus, it is also possible to simultaneously manufacture a plurality of shells 10, and the manufacturing efficiency is improved.

When configured in such a manner, due to the relationship between the shape of the shell 10 to be manufactured and the posture (that is, orientation) of the shell 10 at the time of manufacturing, it is necessary to form a support portion 400 as illustrated in FIGS. 10 and 11 separately from the shell 10 so that the shape of the relatively soft shell 10 is still maintained during the manufacturing. The support portion 400 is separated from the shell 10 and removed after the shell 10 is manufactured.

Here, in the shoe 1A according to the present embodiment, as described above, the medial foot side highly rigid portion 14A provided in the medial foot side peripheral wall portion 12A extends from the front end of the shoe 1A to the rear end of the shoe 1A, and the lateral foot side rib portion 15B provided in the lateral foot side peripheral wall portion 12B also extends from the front end of the shoe 1A to the rear end of the shoe 1A.

Therefore, as illustrated in FIG. 10, in the movement step of the platform 202 and the exposure step of the liquid polymer material 300 which are repeatedly performed and described above, the medial foot side highly rigid portion 14A and the lateral foot side highly rigid portion 14B are always included in the newly additively manufactured layer (in the drawing, only the lateral foot side highly rigid portion 14B appears), and the medial foot side highly rigid portion 14A and the lateral foot side highly rigid portion 14B of the already additively manufactured portion reach the vicinity of the platform 202 through the shell 10 of the portion where the additive manufacturing is completed. Furthermore, a portion of the shell 10 in the vicinity of the platform 202 is connected to the platform 202 via the support portion 400. Therefore, the inner bottom surface of the reservoir 201 and the lower surface of the platform 202 are substantially connected via the medial foot side highly rigid portion 14A and the lateral foot side highly rigid portion 14B having relatively high rigidity and the support portion 400.

Therefore, when the platform 202 is moved to peel off the newly additively manufactured layer from the inner bottom surface of the reservoir 201, the tensile force generated by moving the platform 202 is propagated to the newly additively manufactured layer through the medial foot side highly rigid portion 14A and the lateral foot side highly rigid portion 14B having relatively high rigidity and the support portion 400 located substantially continuously.

Therefore, by adopting the configuration as in Embodiment 1 described above, the newly additively manufactured layer is more reliably peeled off from the inner bottom surface of the reservoir 201, and thus, it is possible to obtain a secondary effect of preventing the occurrence of a manufacturing defect of the shell 10 due to the newly additively manufactured layer remaining attached to the inner bottom surface of the reservoir 201.

Further, by adopting the configuration as in Embodiment 1 described above, the medial foot side highly rigid portion 14A and the lateral foot side highly rigid portion 14B having relatively high rigidity reach the vicinity of the platform 202, and thus, the support portion 400 can be omitted from the portion where the medial foot side highly rigid portion 14A and the lateral foot side highly rigid portion 14B are located.

Therefore, since the amount of the support portion 400 to be cut off after the manufacturing of the shell 10 is reduced, the work can be facilitated and the generation amount of waste material can be reduced, and as a result, the manufacturing cost can be reduced. In addition, by reducing the amount of the support portion 400, it is possible to reduce cutting marks generated in the shell 10 when the support portion 400 is separated from the shell 10, and the aesthetic appearance of the shell 10 is improved.

(F. Still Another Aspect of Highly Rigid Portion)

FIGS. 12A to 13B are schematic cross-sectional views illustrating a fourth to an eighth configuration examples, each of which is still another aspect of the highly rigid portion provided in the shell included in the shoe illustrated in FIG. 1. Hereinafter, the fourth to the eighth configuration examples, each of which is another aspect of the highly rigid portion according to the present embodiment, will be described with reference to FIGS. 12A to 13B.

In FIG. 6 described above, the case where the medial foot side highly rigid portion 14A is provided along the two medial foot side rib portions 15A provided on the medial foot side peripheral wall portion 12A and the lateral foot side highly rigid portion 14B is provided along the two lateral foot side rib portions 15B provided on the lateral foot side peripheral wall portion 12B has been illustrated, and the fourth to eighth configuration examples described below each illustrate a preferred aspect of a case where the two rib portions are provided on the peripheral wall portion and the highly rigid portion is provided along the two rib portions in this manner. In the following description, the medial foot side and the lateral foot side are not distinguished from each other.

As illustrated in FIGS. 12A to 13A, in shoes 1A4 to 1A7 according to the fourth to the seventh configuration examples, a first rib portion 115 and a second rib portion 125 are provided in parallel at the upper and lower positions of the peripheral wall portion 12, the first rib portion 115 has one first ridge 110 extending along the extending direction thereof, and the second rib portion 125 has one second ridge 120 extending along the extending direction thereof.

The first rib portion 115 includes a first upper surface 111 and a first lower surface 112 separated by the first ridge 110, and the second rib portion 125 includes a second upper surface 121 and a second lower surface 122 separated by the second ridge 120. That is, the outer surface (that is, the outer peripheral surface 12*b*) of the peripheral wall portion 12 located on the side opposite to the insertion space SP3 has an inverted W shape in a cross-sectional view in a portion where the first rib portion 115 and the second rib portion 125 are provided.

Figure 12A:
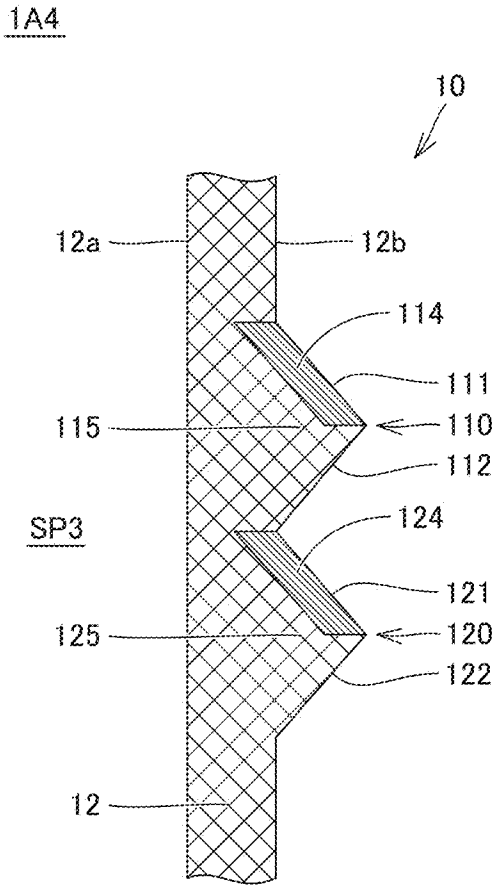
FIG. 12A is a schematic cross-sectional view illustrating a fourth configuration example which is still another aspect of the highly rigid portion provided in the shell included in the shoe illustrated in FIG. 1.

As illustrated in FIG. 12A, in the shoe 1A4 according to the fourth configuration example, a first highly rigid portion 114 is provided on the first upper surface 111 of the first rib portion 115, no highly rigid portion is provided on the first lower surface 112 of the first rib portion 115, and the first lower surface 112 is formed of a three-dimensional mesh structure body. In the shoe 1A4 according to the fourth configuration example, a second highly rigid portion 124 is provided on the second upper surface 121 of the second rib portion 125, no highly rigid portion is provided on the second lower surface 122 of the second rib portion 125, and the second lower surface 122 is formed of a three-dimensional mesh structure body.

Figure 12B:
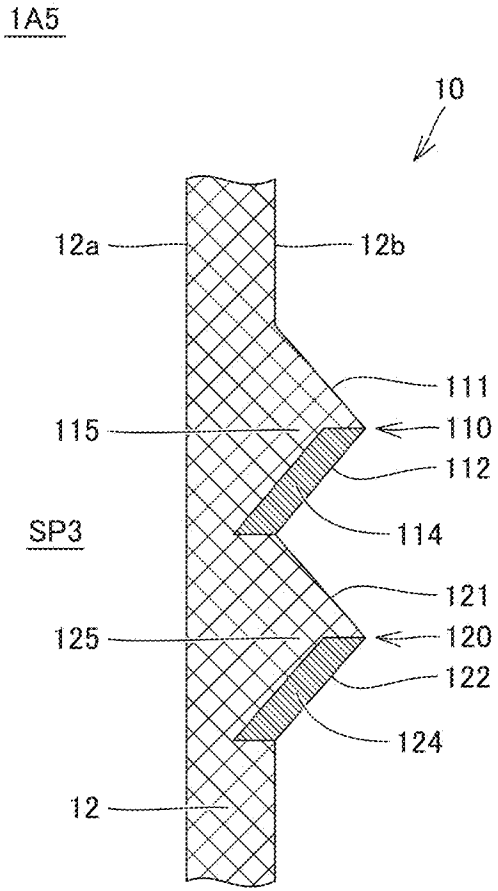
FIG. 12B is a schematic cross-sectional view illustrating a fifth configuration example which is still another aspect of the highly rigid portion provided in the shell included in the shoe illustrated in FIG. 1.

As illustrated in FIG. 12B, in the shoe 1A5 according to the fifth configuration example, no highly rigid portion is provided on the first upper surface 111 of the first rib portion 115, the first upper surface 111 is formed of a three-dimensional mesh structure body, and the first highly rigid portion 114 is provided on the first lower surface 112 of the first rib portion 115. In the shoe 1A5 according to the fifth configuration example, no highly rigid portion is provided on the second upper surface 121 of the second rib portion 125, the second upper surface 121 is formed of a three-dimensional mesh structure body, and the second highly rigid portion 124 is provided on the second lower surface 122 of the second rib portion 125.

Figure 12C:
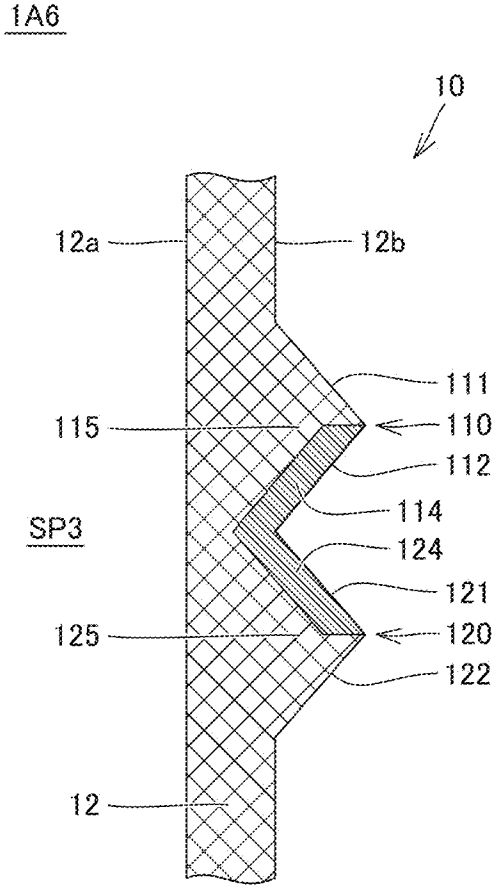
FIG. 12C is a schematic cross-sectional view illustrating a sixth configuration example which is still another aspect of the highly rigid portion provided in the shell included in the shoe illustrated in FIG. 1.

As illustrated in FIG. 12C, in the shoe 1A6 according to the sixth configuration example, no highly rigid portion is provided on the first upper surface 111 of the first rib portion 115, the first upper surface 111 is formed of a three-dimensional mesh structure body, and the first highly rigid portion 114 is provided on the first lower surface 112 of the first rib portion 115. In the shoe 1A6 according to the sixth configuration example, the second highly rigid portion 124 is provided on the second upper surface 121 of the second rib portion 125, no highly rigid portion is provided on the second lower surface 122 of the second rib portion 125, and the second lower surface 122 is formed of a three-dimensional mesh structure body.

Figure 13B:
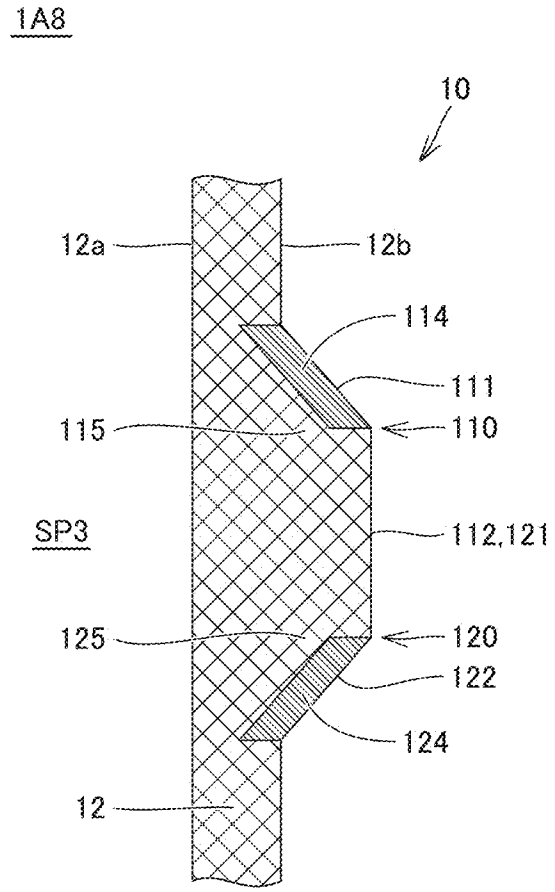
FIG. 13B is a schematic cross-sectional view illustrating an eighth configuration example which is still another aspect of the highly rigid portion provided in the shell included in the shoe illustrated in FIG. 1.
Figure 13A:
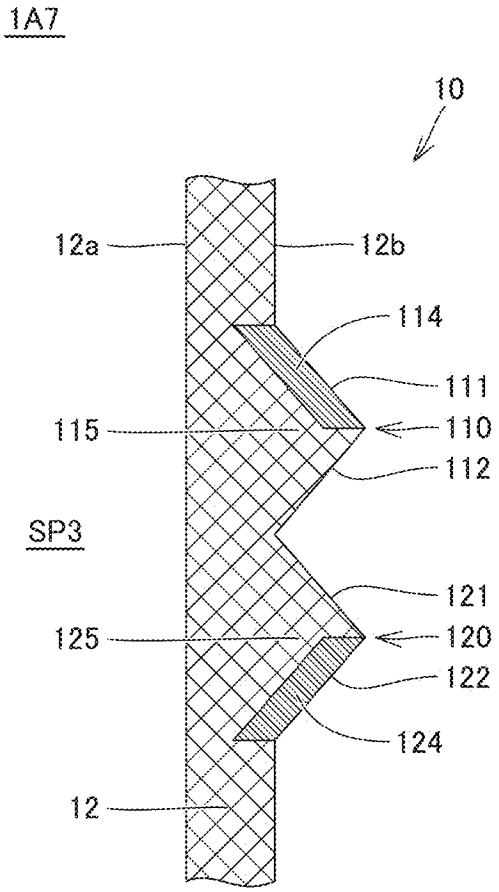
FIG. 13A is a schematic cross-sectional view illustrating a seventh configuration example which is still another aspect of the highly rigid portion provided in the shell included in the shoe illustrated in FIG. 1.

As illustrated in FIG. 13A, in the shoe 1A7 according to the seventh configuration example, the first highly rigid portion 114 is provided on the first upper surface 111 of the first rib portion 115, no highly rigid portion is provided on the first lower surface 112 of the first rib portion 115, and the first lower surface 112 is formed of a three-dimensional mesh structure body. In the shoe 1A7 according to the seventh configuration example, no highly rigid portion is provided on the second upper surface 121 of the second rib portion 125, the second upper surface 121 is formed of a three-dimensional mesh structure body, and the second highly rigid portion 124 is provided on the second lower surface 122 of the second rib portion 125.

As illustrated in FIG. 13B, in a shoe 1A8 according to the eighth configuration example, the first rib portion 115 and the second rib portion 125 are provided in parallel at the upper and lower positions of the peripheral wall portion 12, but the first ridge 110 and the second ridge 120 are connected by substantially one surface. Therefore, the first lower surface 112 of the first rib portion 115 and the second upper surface 121 of the second rib portion 125 are each formed of one surface described above.

In the shoe 1A8 according to the eighth configuration example, the first highly rigid portion 114 is provided on the first upper surface 111 of the first rib portion 115, and the second highly rigid portion 124 is provided on the second lower surface 122 of the second rib portion 125. On the other hand, the first lower surface 112 of the first rib portion 115 and the second upper surface 121 of the second rib portion 125, which are each formed of one surface described above, are not provided with a highly rigid portion, but are each formed of a three-dimensional mesh structure body.

As described above, it is preferable that when the outer surface of the portion of the peripheral wall portion 12 corresponding to the rib portion includes an upper surface and a lower surface separated by one ridge extending in the extending direction of the rib portion, the highly rigid portion is provided only on one of the upper surface and the lower surface.

With such a configuration, the formability of the shell 10 can be enhanced. Hereinafter, the reason thereof will be described.

When the shell 10 is manufactured by the three-dimensional additive manufacturing described above, there is a concern that deformation may occur in the shell 10 due to the own weight of the shell 10 being manufactured at the time of manufacturing. In particular, the shell 10 formed of the three-dimensional mesh structure body as described above has a relatively low rigidity and is more likely to be deformed at the time of manufacturing described above, and when deformation occurs, the deformation causes a manufacturing defect.

In this regard, as described above, in the shell 10, the medial foot side highly rigid portion 14A and the lateral foot side highly rigid portion 14B extend from the front end of the shoe 1A to the rear end of the shoe 1A, and thus, the above-described lack of rigidity is eliminated, and deformation at the time of manufacturing is less likely to occur. Conversely, when the widths of the medial foot side highly rigid portion 14A and the lateral foot side highly rigid portion 14B (widths in a direction parallel to the outer surface of the shell 10 and orthogonal to the manufacturing direction (that is, the widths of the shell 10 in the direction substantially along the up-down direction Z)) are extremely large, the weight of the shell 10 increases, and the deformation due to the above-described own weight becomes dominant, and thus, a manufacturing defect is more likely to occur.

Therefore, by adopting the shoes 1A4 to 1A7 according to the fourth to the seventh configuration examples described above, the above-described lack of rigidity is eliminated while suppressing the increase in the weight of the shell 10, and the formability of the shell 10 is enhanced. Furthermore, in the three-dimensional additive manufacturing based on the vat photopolymerization method described above, when the additively manufactured product is additively manufactured in a direction exceeding 45° with respect to the manufacturing direction (see the direction of the arrow DR2 in FIGS. 10 and 11), the manufacturing defect due to the own weight described above is more likely to occur, and thus, in that sense as well, it is preferable to adopt the configuration like the shoes 1A4 to 1A7 according to the fourth to the seventh configuration examples described above in which the medial foot side highly rigid portion 14A and the lateral foot side highly rigid portion 14B do not extend beyond 45° with respect to the manufacturing direction.

As described above, it is preferable that when the outer surface of the portion of the peripheral wall portion 12 corresponding to the rib portion includes an upper surface and a lower surface separated by one ridge extending in the extending direction of the rib portion, the highly rigid portion is provided only on one of the upper surface and the lower surface. However, the highly rigid portion is not necessarily configured as described above, and may be provided across both the upper surface and the lower surface. In addition, when the highly rigid portion is provided only on any one of the upper surface and the lower surface, the highly rigid portion is preferably provided on the lower surface from the viewpoint of preventing collapse of the peripheral wall portion from a lower position.

In the above, the description has been given by illustrating the case where two rib portions extending in parallel are provided on the peripheral wall portion, but the number of rib portions is not necessarily two, and one rib portion or three or more rib portions may be provided instead.

Embodiments 2 to 7

FIGS. 14 to 19 are side views of shoes according to Embodiments 2 to 7, respectively, as viewed from the lateral foot side. Below, with reference to FIGS. 14 to 19, shoes 1B to 1G according to Embodiments 2 to 7 will be described. The shoes 1B to 1G according to Embodiments 2 to 7 are different from the shoe 1A according to Embodiment 1 described above only in the configurations of the medial foot side highly rigid portion 14A and the lateral foot side highly rigid portion 14B provided in the shell 10. Here, in FIGS. 14 to 19, only the lateral foot side highly rigid portion 14B appears, and hereinafter, the description will be given focusing on the lateral foot side highly rigid portion 14B, but the medial foot side highly rigid portion 14A has the same configuration.

Figure 14:
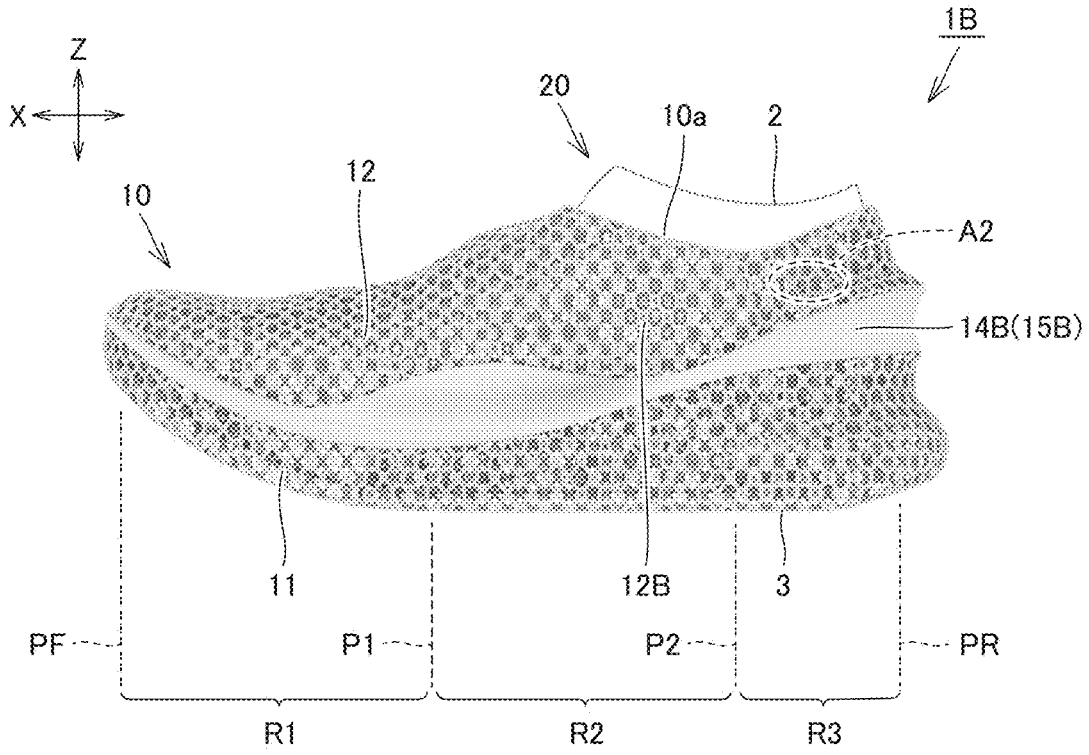
FIG. 14 is a side view of a shoe according to Embodiment 2 as viewed from a lateral foot side.

As illustrated in FIG. 14, the shoe 1B according to Embodiment 2 is different from the shoe 1A according to Embodiment 1 described above in the configuration that the lateral foot side highly rigid portion 14B is configured such that the width in the up-down direction is enlarged in the portion near the rear end of the forefoot portion R1 and the portion near the front end of the midfoot portion R2.

Figure 15:
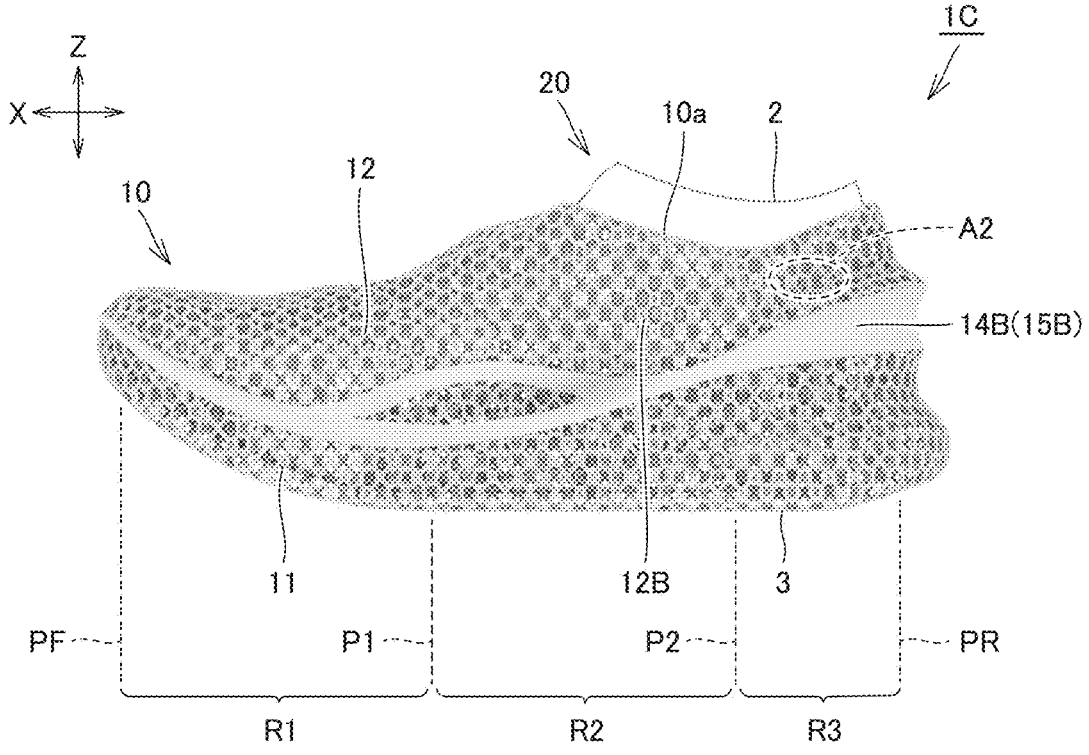
FIG. 15 is a side view of a shoe according to Embodiment 3 as viewed from a lateral foot side.

As illustrated in FIG. 15, the shoe 1C according to Embodiment 3 is different from the shoe 1A according to Embodiment 1 described above in the configuration that the lateral foot side highly rigid portion 14B is bifurcated at the portion near the rear end of the forefoot portion R1 and the portion near the front end of the midfoot portion R2.

Figure 16:
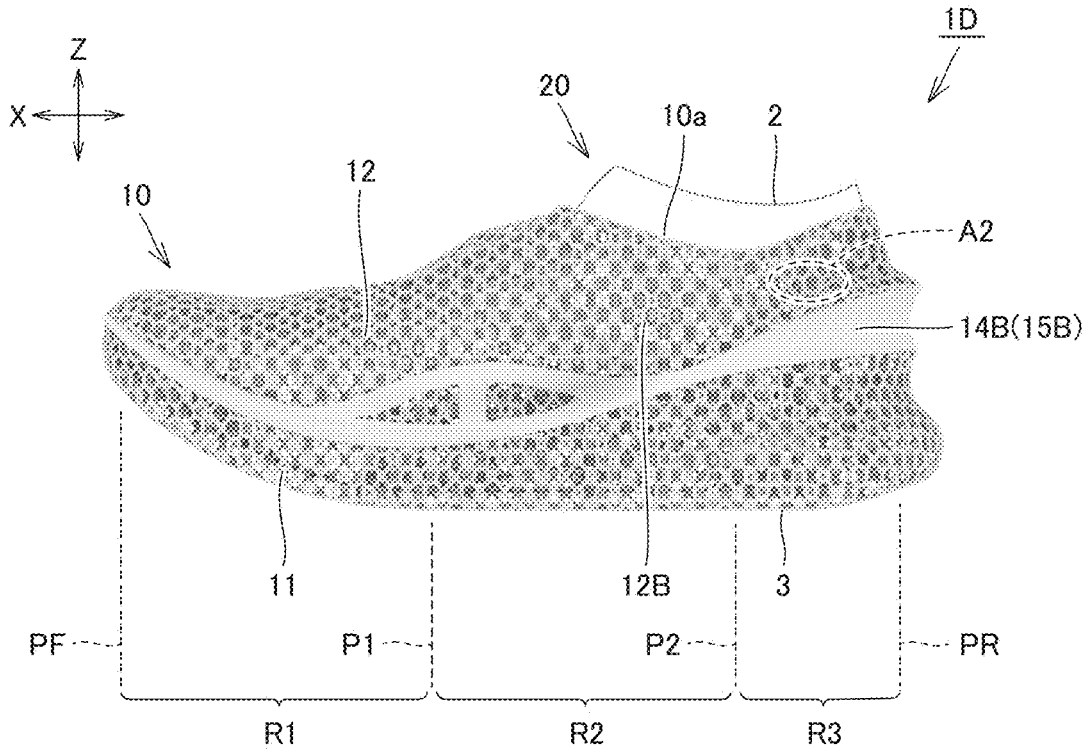
FIG. 16 is a side view of a shoe according to Embodiment 4 as viewed from a lateral foot side.

As illustrated in FIG. 16, the shoe 1D according to Embodiment 4 is different from the shoe 1A according to Embodiment 1 described above in the configuration that the lateral foot side highly rigid portion 14B is bifurcated at the portion near the rear end of the forefoot portion R1 and the portion near the front end of the midfoot portion R2 and the lateral foot side highly rigid portion 14B is connected by a rib-shaped portion extending in the up-down direction Z in the portions where the lateral foot side highly rigid portion 14B is bifurcated.

Figure 17:
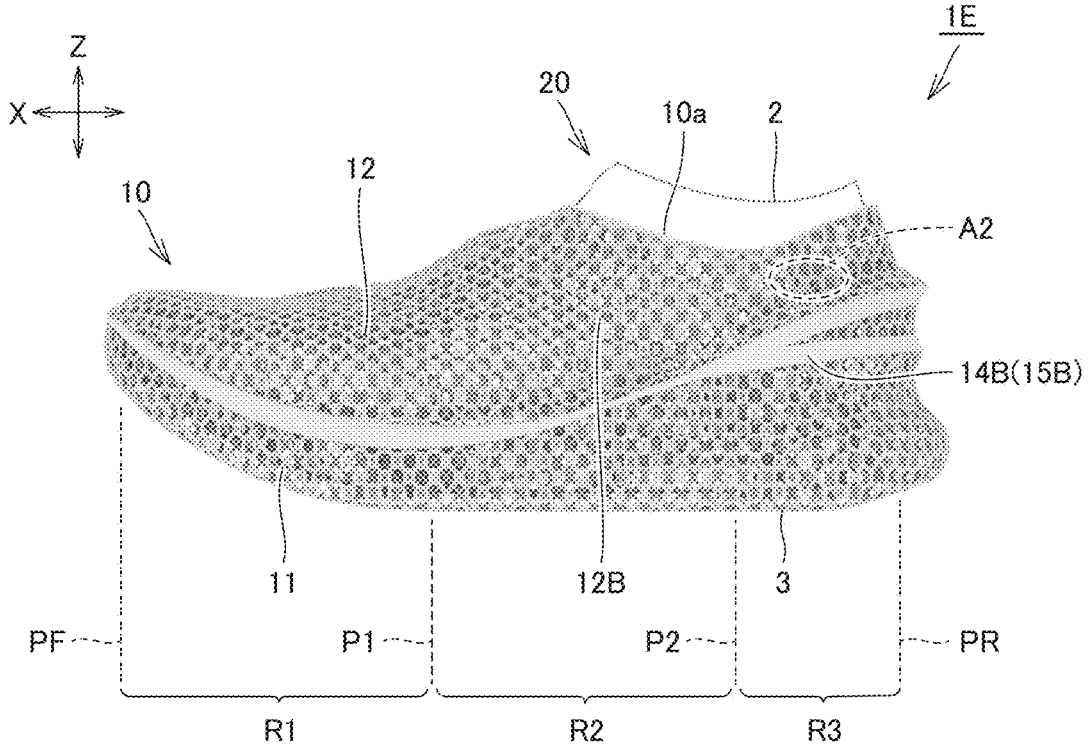
FIG. 17 is a side view of a shoe according to Embodiment 5 as viewed from a lateral foot side.

As illustrated in FIG. 17, the shoe 1E according to Embodiment 5 is different from the shoe 1A according to Embodiment 1 described above in the configuration that the lateral foot side highly rigid portion 14B is bifurcated at the rearfoot portion R3.

Figure 18:
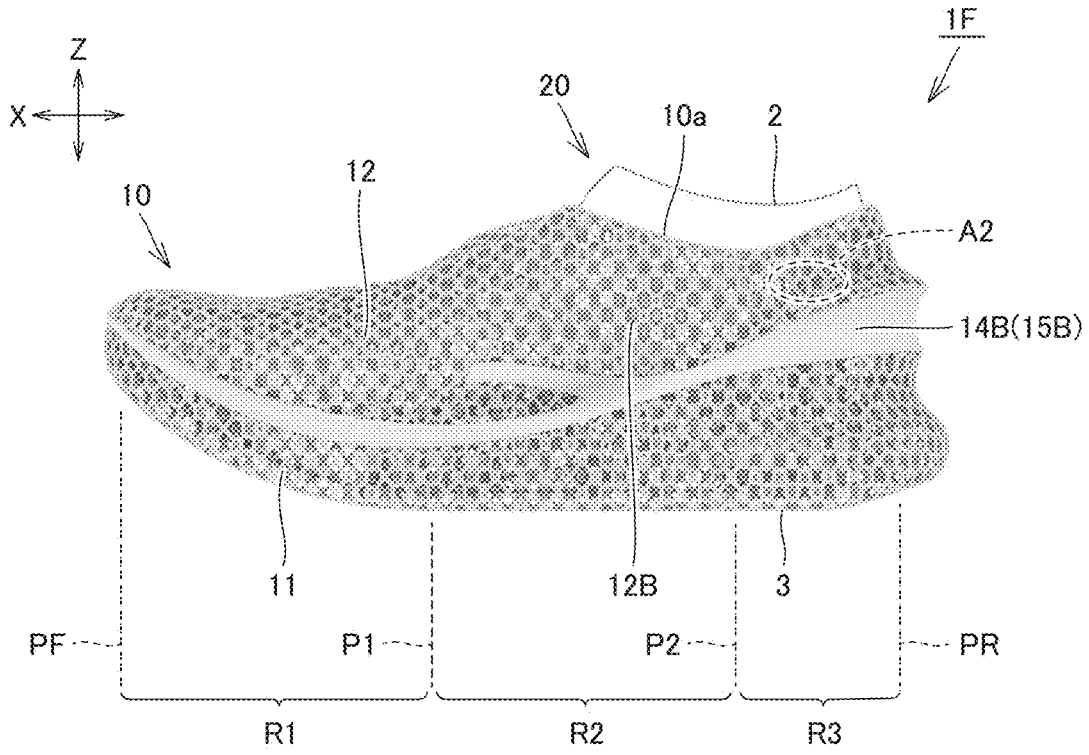
FIG. 18 is a side view of a shoe according to Embodiment 6 as viewed from a lateral foot side.

As illustrated in FIG. 18, the shoe 1F according to Embodiment 6 is different from the shoe 1A according to Embodiment 1 described above in the configuration that the lateral foot side highly rigid portion 14B is bifurcated at the central portion of the midfoot portion R2 and one of the bifurcated portions is interrupted at a portion near the front end of the midfoot portion R2.

Figure 19:
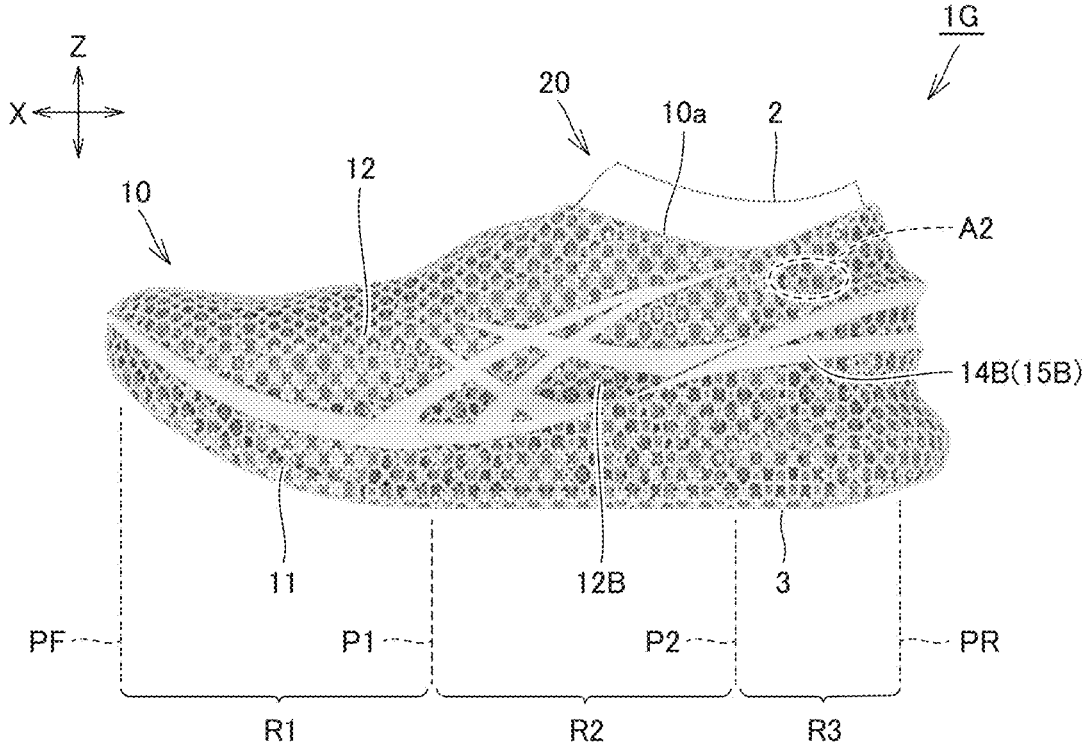
FIG. 19 is a side view of a shoe according to Embodiment 7 as viewed from a lateral foot side.

As illustrated in FIG. 19, the shoe 1G according to Embodiment 7 is different from the shoe 1A according to Embodiment 1 described above in the configuration that the lateral foot side highly rigid portion 14B is bifurcated at the rearfoot portion R3 and complicatedly branches at the midfoot portion R2.

Even in the case of configuring as in the shoes 1B to 1G according to Embodiments 2 to 7, the same effect as that described in Embodiment 1 above can be obtained, and in a shoe including the flexible shell 10 made of an elastic material, it is possible to improve the stationary fit and the dynamic fit of the shell 10 with respect to the foot.

Particularly, when configured as the shoes 1B to 1D and the shoe 1G according to Embodiments 2 to 4 and Embodiment 7, the rigidity of the peripheral wall portion of the shell 10 is enhanced in the portion near the rear end of the forefoot portion R1 and the portion near the front end of the midfoot portion R2, which are portions corresponding to the arch of the foot of the wearer, and thus, it is possible to effectively suppress excessive collapse of the arch of the foot of the wearer. On the other hand, in the portion where the MP joint of the foot of the wearer is located, the highly rigid portion is not configured to be extremely large, and thus, a so-called foot bending motion is not hindered.

Furthermore, particularly, in the shoes 1C and 1D according to Embodiments 3 and 4, the size of the highly rigid portion when viewed as a whole is smaller than that of the shoe 1B according to Embodiment 2, and thus, further weight reduction is achieved, and in the shoe 1D according to Embodiment 4, the branched portions of the highly rigid portion are connected by the rib-shaped portion, and thus, the portion of the shell 10 corresponding to the arch of the foot of the wearer can be made higher in rigidity, and meanwhile, weight reduction can be achieved.

Embodiment 8

Figure 20:
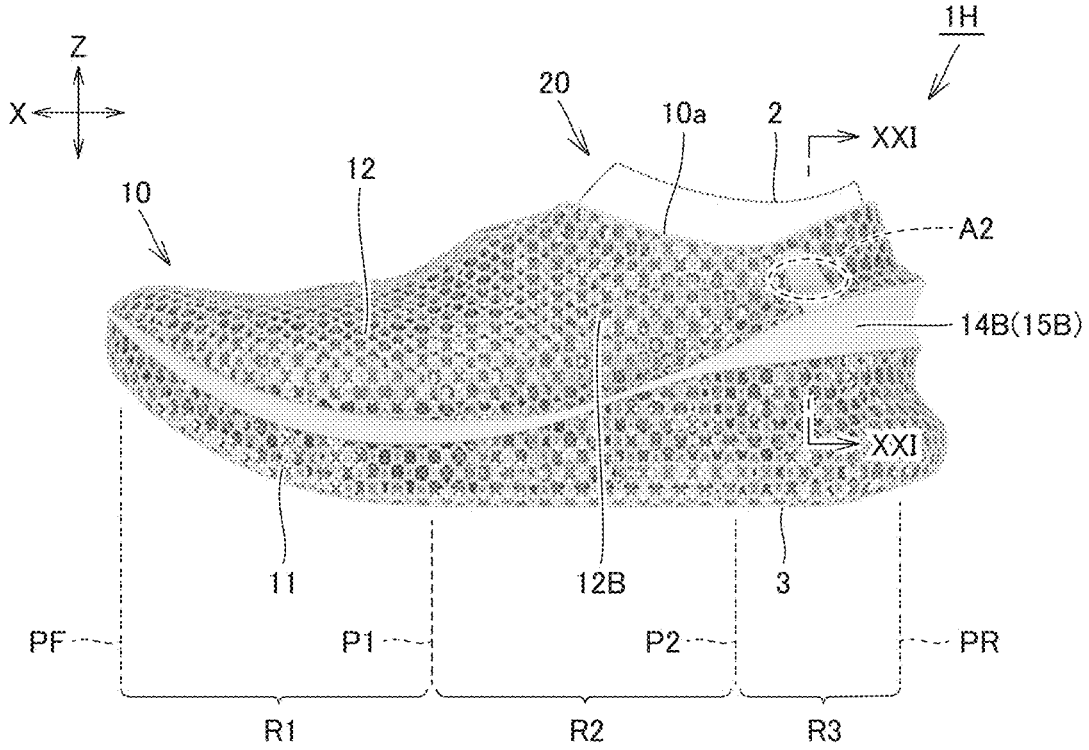
FIG. 20 is a side view of a shoe according to Embodiment 8 as viewed from a lateral foot side.
Figure 21:
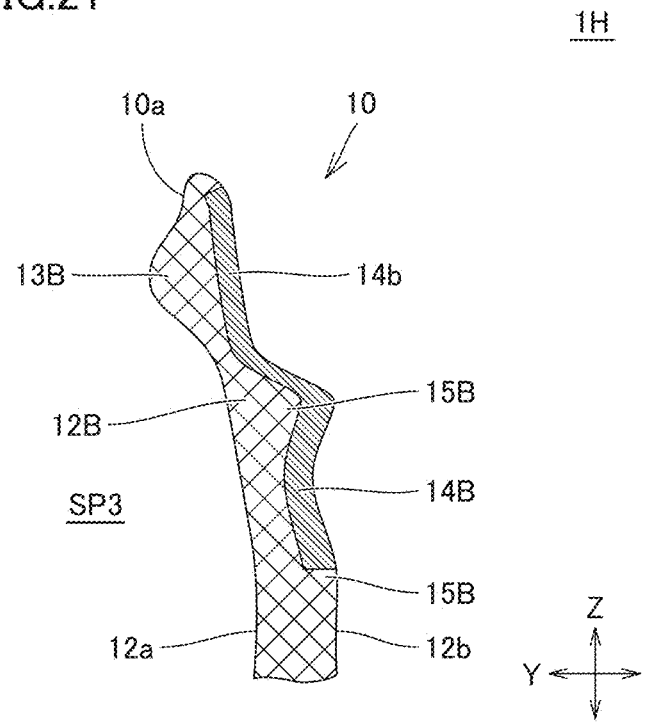
FIG. 21 is a schematic cross-sectional view of a shell included in the shoe illustrated in FIG. 20 taken along line XXI-XXI illustrated in FIG. 20.

FIG. 20 is a side view of the shoe according to Embodiment 8 as viewed from the lateral foot side, and FIG. 21 is a schematic cross-sectional view of a shell included in the shoe illustrated in FIG. 20, taken along line XXI-XXI illustrated in FIG. 20. Hereinafter, the shoe 1H according to Embodiment 8 will be described with reference to FIG. 20 and FIG. 21. The shoe 1H according to Embodiment 8 is different from the shoe 1A according to Embodiment 1 described above only in the configurations of the medial foot side highly rigid portion 14A and the lateral foot side highly rigid portion 14B provided in the shell 10. Here, in FIG. 20 and FIG. 21, only the lateral foot side highly rigid portion 14B appears, and hereinafter, the description will be given focusing on the lateral foot side highly rigid portion 14B, but the medial foot side highly rigid portion 14A has the same configuration.

As illustrated in FIG. 20, the shoe 1H according to Embodiment 8 is different from the shoe 1A according to Embodiment 1 described above in the configuration that the lateral foot side highly rigid portion 14B is bifurcated at the central portion of the rearfoot portion R3 and one of the bifurcated portions is interrupted at a portion near the front end of the rearfoot portion R3.

Here, the lateral foot side highly rigid portion 14B which is branched at the central portion of the rearfoot portion R3 and is interrupted at the portion near the front end of the rearfoot portion R3 extends in a manner of overlapping a position (a region indicated by a reference sign A2 in FIG. 20) of the lateral foot side peripheral wall portion 12B corresponding to a portion behind the lateral malleolus point of the foot of the wearer. Thus, as illustrated in FIG. 21, a portion of the lateral foot side highly rigid portion 14B is configured as a lateral foot side cover portion 14*b* that covers a portion of the lateral foot side peripheral wall portion 12B where the lateral foot side bulging portion 13B is provided.

With such a configuration, when the lateral foot side bulging portion 13B comes into contact with the foot of the wearer at the time of wearing and is compressed and deformed, the uplift of the lateral foot side peripheral wall portion 12B of the portion where the lateral foot side bulging portion 13B is provided from the foot of the wearer can be effectively suppressed, and the compressive deformation of the lateral foot side bulging portion 13B is promoted. That is, the lateral foot side cover portion 14*b* functions as a pressing portion that prevents uplift of the lateral foot side peripheral wall portion 12B of the portion where the lateral foot side bulging portion 13B is provided.

Therefore, when configured in such a manner, not only the same effect as the effect described in Embodiment 1 described above can be obtained, but also a shoe can be obtained in which the stationary fit and the dynamic fit of the shell 10 with respect to the foot are further improved at the position behind the malleolus of the foot of the wearer.

Embodiments 9 to 13

FIGS. 22 to 26 are side views of shoes according to Embodiments 9 to 13, respectively, as viewed from the lateral foot side. Below, with reference to FIGS. 22 to 26, shoes 1I to 1M according to Embodiments 9 to 13 will be described. The shoes 1I to 1M according to Embodiments 9 to 13 are different from the shoe 1A according to Embodiment 1 described above only in the configurations of the medial foot side highly rigid portion 14A and the lateral foot side highly rigid portion 14B provided in the shell 10. Here, in FIGS. 22 to 26, only the lateral foot side highly rigid portion 14B appears, and hereinafter, the description will be given focusing on the lateral foot side highly rigid portion 14B, but the medial foot side highly rigid portion 14A has the same configuration.

Figure 22:
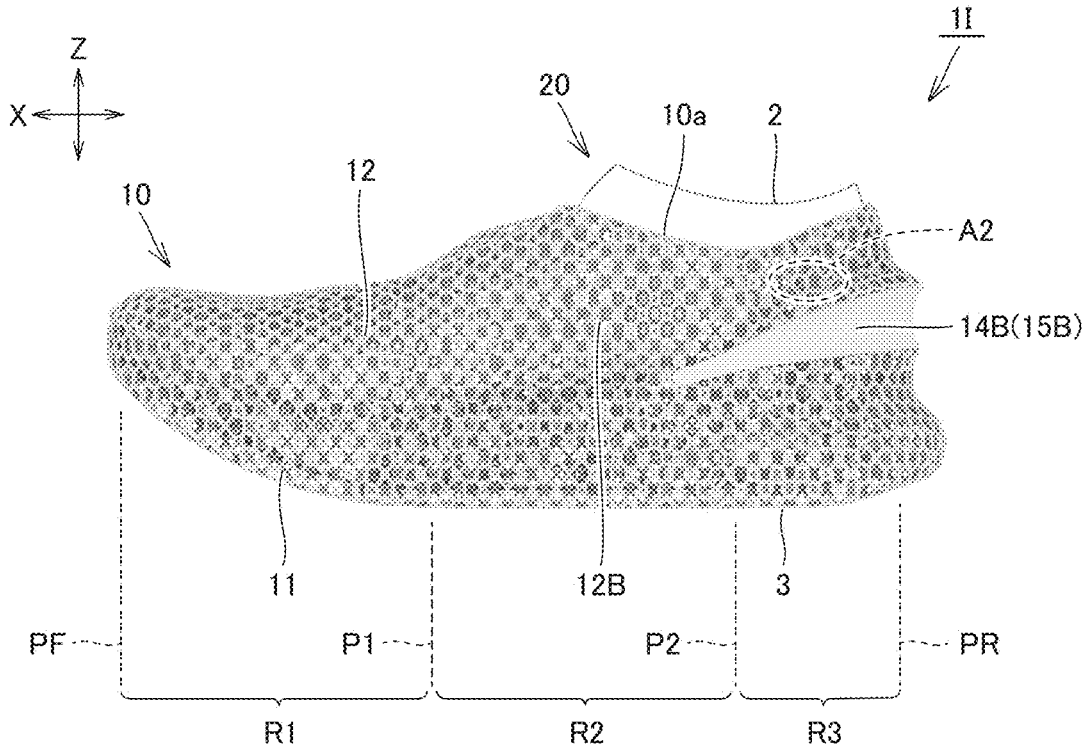
FIG. 22 is a side view of a shoe according to Embodiment 9 as viewed from a lateral foot side.

As illustrated in FIG. 22, the shoe 1I according to Embodiment 9 is different from the shoe 1A according to Embodiment 1 described above in the configuration that the lateral foot side highly rigid portion 14B is interrupted at a portion near the rear end of the forefoot portion R1.

Figure 23:
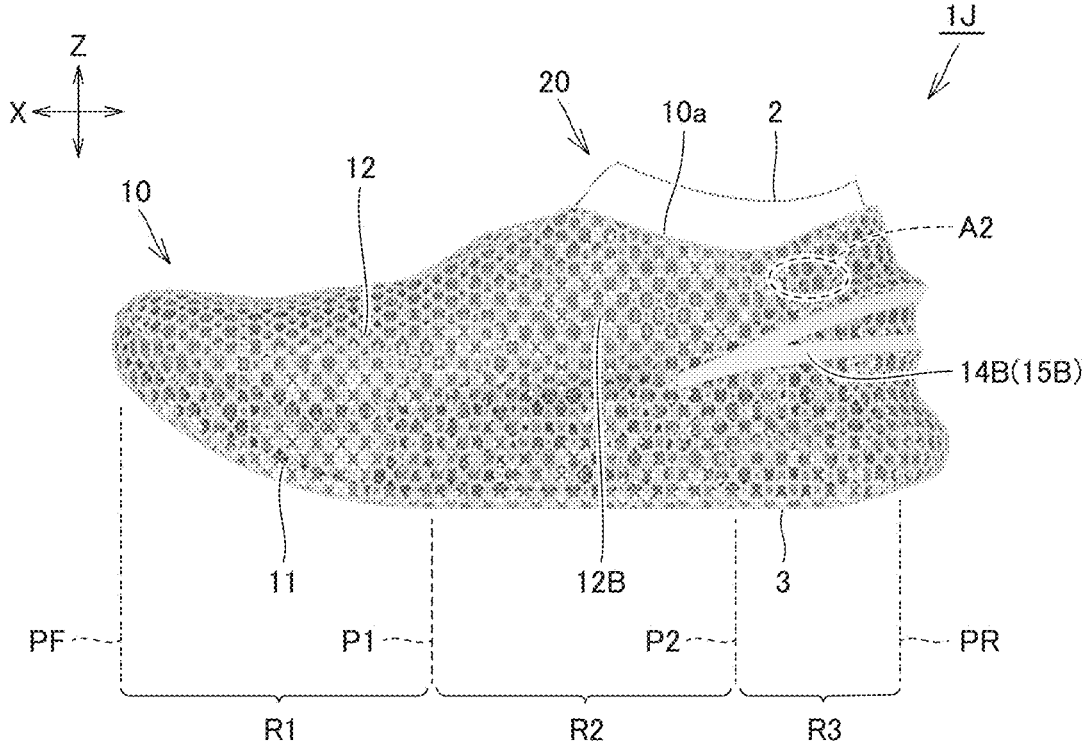
FIG. 23 is a side view of a shoe according to Embodiment 10 as viewed from a lateral foot side.

As illustrated in FIG. 23, the shoe 1J according to Embodiment 10 is different from the shoe 1A according to Embodiment 1 described above in the configuration that the lateral foot side highly rigid portion 14B is interrupted at the portion near the rear end of the forefoot portion R1 and bifurcated at the rearfoot portion R3.

Figure 24:
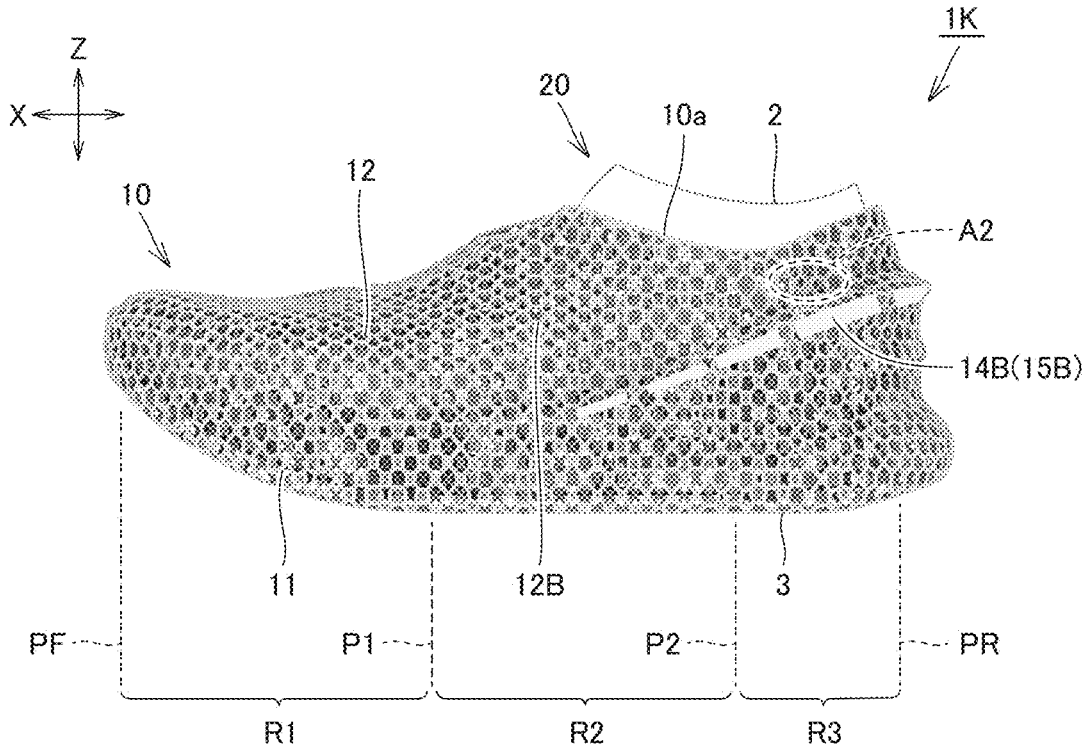
FIG. 24 is a side view of a shoe according to Embodiment 11 as viewed from a lateral foot side.

As illustrated in FIG. 24, the shoe 1K according to Embodiment 11 is different from the shoe 1A according to Embodiment 1 described above in the configuration that the lateral foot side highly rigid portion 14B is interrupted at the portion near the rear end of the forefoot portion R1 and the lateral foot side highly rigid portion 14B is divided into a plurality of portions in the front-rear direction X to intermittently extend in the rearfoot portion R3.

Figure 25:
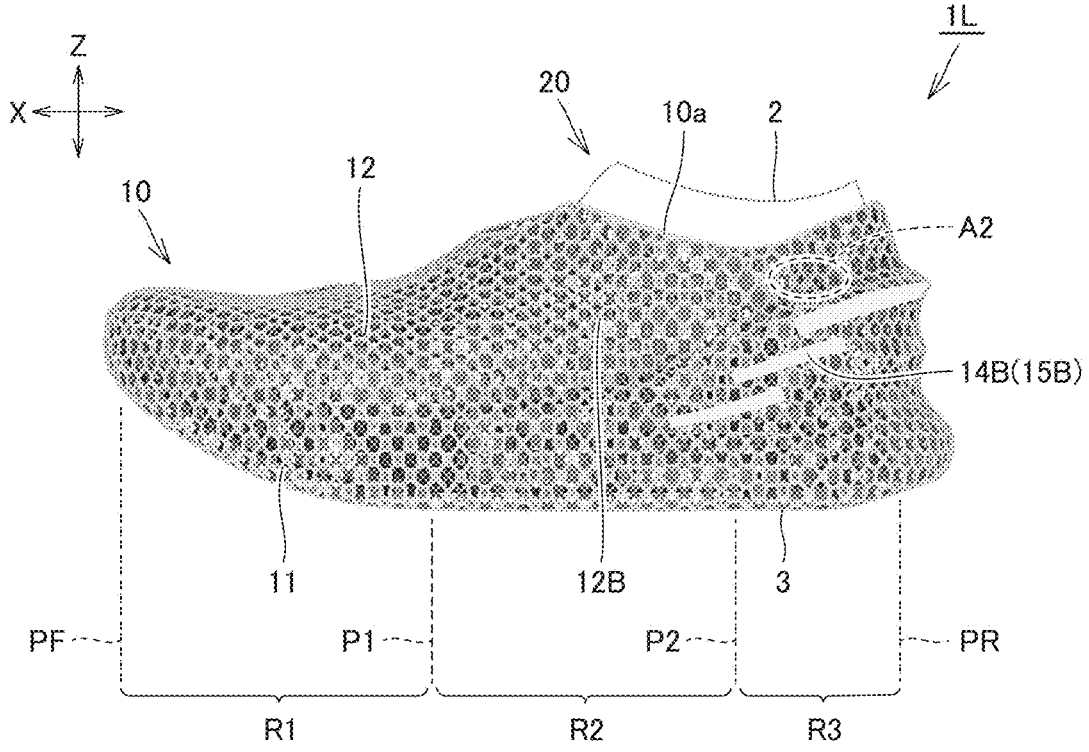
FIG. 25 is a side view of a shoe according to Embodiment 12 as viewed from a lateral foot side.

As illustrated in FIG. 25, in the shoe 1L according to Embodiment 12, the lateral foot side highly rigid portion 14B is divided into a plurality of portions and arranged from the position near the rear end of the midfoot portion R2 to the rearfoot portion R3, and these divided portions of the lateral foot side highly rigid portion 14B are configured to be shifted from each other in the up-down direction Z.

Figure 26:
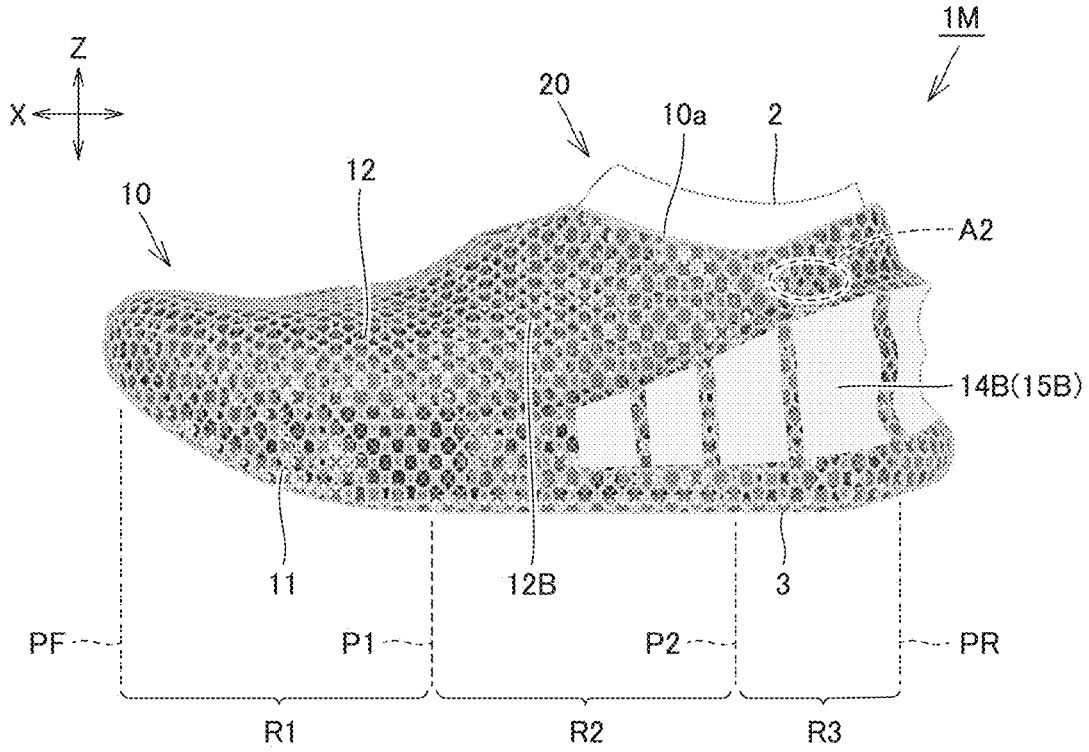
FIG. 26 is a side view of a shoe according to Embodiment 13 as viewed from a lateral foot side.

As illustrated in FIG. 26, in the shoe 1M according to Embodiment 13, the lateral foot side highly rigid portion 14B is divided into a plurality of portions and arranged from the central portion in the front-rear direction X of the midfoot portion R2 to the rearfoot portion R3, and these divided portions of the lateral foot side highly rigid portion 14B are configured to extend in the up-down direction Z in a manner of being arranged substantially over the entire portion on the lower end side of the lateral foot side peripheral wall portion 12B.

Even in the case of configuring as in the shoes 1I to 1M according to Embodiments 9 to 13, the same effect as that described in Embodiment 1 above can be obtained, and in a shoe including the flexible shell 10 made of an elastic material, it is possible to improve the stationary fit and the dynamic fit of the shell with respect to the foot. Particularly, in the shoes 1L and 1M according to Embodiments 12 and 13, the highly rigid portion is provided up to the position below the peripheral wall portion, and thus, it is possible to suppress the collapse of the peripheral wall portion from the position below the peripheral wall portion.

SUMMARY OF DISCLOSURES IN EMBODIMENTS

The characteristic configurations disclosed in the embodiments described above are summarized as follows.

[Supplementary Note 1]

A shoe including: a shell including an insertion space inside the shell and configured to receive a foot of a wearer, the shell being made of an elastic material, and surrounding the insertion space, wherein the shell includes a bottom wall portion configured to support a sole of the foot of the wearer, and a peripheral wall portion that is configured to cover a peripheral surface of the foot of the wearer by standing from a peripheral edge of the bottom wall portion, a bulging portion, which bulges toward the insertion space and includes an easy-deformable portion configured of a three-dimensional mesh structure body, is at a position of the peripheral wall portion corresponding to at least one of a portion behind a medial malleolus point of the foot of the wearer and a portion behind a lateral malleolus point of the foot of the wearer, a highly rigid portion, which is a hard-deformable portion having higher rigidity than the easy-deformable portion, is at a position of the peripheral wall portion lower than a portion of the peripheral wall portion provided with the bulging portion, and at least a portion of the peripheral wall portion including the bulging portion and the highly rigid portion is configured of a single member.

By adopting the configuration according to Supplementary Note 1, the gap between the recess of the portion located behind the malleolus of the peripheral surface of the foot of the wearer and the peripheral wall portion of the shell is reduced by the bulging portion at the time of wearing, and the bulging portion is appropriately compressed and deformed since the bulging portion is formed of the three-dimensional mesh structure body, and thus, the stationary fit is improved. In addition, by adopting the configuration, the highly rigid portion suppresses collapse of the portion provided with the bulging portion toward the outside of the peripheral wall portion, thereby enhancing the dynamic fit. Therefore, with such a configuration, it is possible to improve the stationary fit and the dynamic fit of the shell with respect to the foot at the position behind the malleolus of the foot of the wearer in the shoe including the flexible shell made of the elastic material.

[Supplementary Note 2]

The shoe according to Supplementary Note 1, wherein the highly rigid portion is located on an outer surface of the peripheral wall portion.

By adopting the configuration according to Supplementary Note 2, collapse toward the outside of the peripheral wall portion can be more reliably suppressed, and the stationary fit and the dynamic fit can be more reliably improved.

[Supplementary Note 3]

The shoe according to Supplementary Note 1, wherein the highly rigid portion has a belt-like shape extending in a front-rear direction in a portion on a rear end side of the shoe.

By adopting the configuration according to Supplementary Note 3, the rigidity required as a highly rigid portion can be secured, and thus, the stationary fit and the dynamic fit can be more reliably improved.

[Supplementary Note 4]

The shoe according to Supplementary Note 3, wherein the highly rigid portion reaches a front end and a rear end of the shoe.

By adopting the configuration according to Supplementary Note 4, not only the stationary fit and the dynamic fit of the shell with respect to the foot can be improved at the position behind the malleolus of the foot of the wearer, but also the stationary fit and the dynamic fit with respect to the entire foot of the wearer can be improved.

[Supplementary Note 5]

The shoe according to Supplementary Note 3 or 4, wherein the highly rigid portion is inclined downward extending toward a front side of the shoe in a portion on a rear end side of the shoe.

By adopting the configuration according to Supplementary Note 5, it is possible to provide a shoe having excellent stability at the time of foot landing in the forefoot portion and the midfoot portion.

[Supplementary Note 6]

The shoe according to any one of Supplementary Notes 3 to 5, wherein the highly rigid portion includes a branched portion.

By adopting the configuration according to Supplementary Note 6, both improvement in the stationary fit and the dynamic fit and weight reduction of the shoe can be achieved.

[Supplementary Note 7]

The shoe according to any one of Supplementary Notes 3 to 6, wherein the peripheral wall portion includes a rib portion that extends in an extending direction of the highly rigid portion in a portion where the highly rigid portion is provided and protrudes toward a side opposite to a side of the insertion space, and the highly rigid portion is on an outer surface of a portion corresponding to the rib portion of the peripheral wall portion.

By adopting the configuration according to Supplementary Note 7, the rib portion is further provided on the peripheral wall portion of the portion where the highly rigid portion is provided, and thus, it is possible to secure the necessary thickness of the highly rigid portion, and it is possible to more reliably improve the dynamic fit.

[Supplementary Note 8]

The shoe according to Supplementary Note 7, wherein the outer surface of the portion of the peripheral wall portion corresponding to the rib portion includes an upper surface and a lower surface separated by one ridge extending in an extending direction of the rib portion, and the highly rigid portion is only on one of the upper surface or the lower surface.

By adopting the configuration according to Supplementary Note 8, particularly when the shell is manufactured by the three-dimensional additive manufacturing method based on the vat photopolymerization method, the formability of the shell can be enhanced.

[Supplementary Note 9]

The shoe according to any one of Supplementary Notes 1 to 8, wherein a portion of the peripheral wall portion corresponding to a rear end portion of the shoe, excluding the highly rigid portion, is entirely configured of a three-dimensional mesh structure body.

By adopting the configuration according to Supplementary Note 9, it is possible to promote weight reduction of the shoe while improving the stationary fit and the dynamic fit.

[Supplementary Note 10]

The shoe according to any one of Supplementary Notes 1 to 9, wherein the highly rigid portion is configured of a solid structure.

By adopting the configuration according to Supplementary Note 10, the rigidity of the highly rigid portion can be maximized, and thus, the dynamic fit can be more reliably improved.

[Supplementary Note 11]

The shoe according to any one of Supplementary Notes 1 to 10, wherein the shell is configured of a single additively manufactured product which is manufactured by a three-dimensional additive manufacturing method.

By adopting the configuration according to Supplementary Note 11, the entire shell consists of a single component, and thus, the number of components can be reduced and the manufacturing cost can be reduced.

[Supplementary Note 12]

The shoe according to any one of Supplementary Notes 1 to 11, wherein the bottom wall portion has a ground contact surface.

By adopting the configuration according to Supplementary Note 12, it is not necessary to separately provide an outsole, and thus, the number of components can be reduced and the manufacturing cost can be reduced.

[Supplementary Note 13]

The shoe according to any one of Supplementary Notes 1 to 12, further including: an upper body that is in the shell and includes an accommodating portion which is bag-shaped and has an opening portion configured to receive a foot of the wearer, wherein the bulging portion is covered with the upper body.

By adopting the configuration according to Supplementary Note 13, it is possible to provide a shoe with more excellent foot contact while improving the stationary fit and the dynamic fit.

[Supplementary Note 14]

The shoe according to any one of Supplementary Notes 1 to 13, further including a sole body that is above the bottom wall portion by being in the shell and configured to support a sole of the foot of the wearer in cooperation with the bottom wall portion.

By adopting the configuration according to Supplementary Note 14, it is possible to provide a shoe with excellent cushioning property at the time of foot landing and excellent foot contact while improving the stationary fit and the dynamic fit.

(Other Aspects, Etc.)

In the embodiments described above, description has been given by illustrating cases where the bulging portion and the highly rigid portion are provided on both the medial foot side peripheral wall portion and the lateral foot side peripheral wall portion. However, the bulging portion and the highly rigid portion may be provided on only one of the medial foot side peripheral wall portion and the lateral foot side peripheral wall portion, or a configuration may be adopted in which the bulging portion is provided on both the medial foot side peripheral wall portion and the lateral foot side peripheral wall portion while the highly rigid portion is not provided on one of the medial foot side peripheral wall portion and the lateral foot side peripheral wall portion.

In the embodiments described above, description has been given by exemplifying the cases where the bulging portion is entirely formed of a three-dimensional mesh structure body, but as long as at least a portion of the bulging portion includes a portion formed of a three-dimensional mesh structure body, another portion of the bulging portion may be formed of, for example, a solid structure. It is assumed that, as an example of this case, the surface of the bulging portion is covered with a layer formed of a thin solid structure, thereby further improving the foot contact.

In addition, the shape, size, quantity, or the like of the bulging portion, the highly rigid portion, the rib portion and the like disclosed in the embodiments described above can be variously changed without departing from the gist of the present disclosure.

Furthermore, the characteristic configurations illustrated in the embodiments described above can be combined with each other without departing from the gist of the present disclosure.

Although the embodiments of the present invention have been described, it should be understood that the embodiments disclosed herein are illustrative and non-restrictive in every respect. The scope of the present invention is defined by claims, and is intended to include all modifications within the scope and meaning equivalent to the claims.

What is claimed is:

1. A shoe comprising: a shell including an insertion space inside the shell and configured to receive a foot of a wearer, the shell being made of an elastic material, and surrounding the insertion space, wherein the shell includes a bottom wall portion configured to support a sole of the foot of the wearer, and a peripheral wall portion that is configured to cover a peripheral surface of the foot of the wearer, the peripheral wall portion extending upward from a peripheral edge of the bottom wall portion, a bulging portion, which bulges toward the insertion space and is configured as an easy-deformable portion having a three-dimensional lattice structure as a single member, is at a position of the peripheral wall portion and has a shape adapted to correspond to at least one of a recess in the peripheral surface of the foot of the wearer behind a medial malleolus point of the foot of the wearer and a recess in the peripheral surface of the foot of the wearer behind a lateral malleolus point of the foot of the wearer, a highly rigid portion, which is a hard-deformable portion having higher rigidity than the easy-deformable portion, is at a position of the peripheral wall portion lower than a portion of the peripheral wall portion provided with the bulging portion, and at least a portion of the peripheral wall portion including the bulging portion and the highly rigid portion is configured as a single member.

2. The shoe according to claim 1, wherein the highly rigid portion is located on an outer surface of the peripheral wall portion.

3. The shoe according to claim 1, wherein the highly rigid portion has a belt shape extending in a front-rear direction in a portion on a rear end side of the shoe.

4. The shoe according to claim 3, wherein the highly rigid portion reaches a front end of the shoe and a rear end of the shoe.

5. The shoe according to claim 3, wherein the highly rigid portion is inclined downward extending toward a front side of the shoe in a portion on the rear end side of the shoe.

6. The shoe according to claim 3, wherein the highly rigid portion includes a branched portion.

7. The shoe according to claim 3, wherein the peripheral wall portion includes a rib portion that extends in an extending direction of the highly rigid portion in a portion where the highly rigid portion is provided and protrudes toward a side opposite to a side of the insertion space, and the highly rigid portion is on an outer surface of a portion corresponding to the rib portion of the peripheral wall portion.

8. The shoe according to claim 1, wherein a portion of the peripheral wall portion corresponding to a rear end portion of the shoe, excluding the highly rigid portion, is entirely configured as a three-dimensional mesh structure body.

9. The shoe according to claim 1, wherein the highly rigid portion is configured as a solid structure.

10. The shoe according to claim 1, wherein the shell is configured as a single additively manufactured product which is manufactured by a three-dimensional additive manufacturing method.

11. The shoe according to claim 1, wherein the bottom wall portion has a ground contact surface.

12. The shoe according to claim 1, further comprising: an upper body that is in the shell and includes an accommodating portion which is bag-shaped and has an opening portion configured to receive the foot of the wearer, wherein the bulging portion is covered with the upper body.

13. The shoe according to claim 1, further comprising a sole body that is above the bottom wall portion by being in the shell and configured to support the sole of the foot of the wearer in cooperation with the bottom wall portion.

14. A shoe comprising a shell including an insertion space inside the shell and configured to receive a foot of a wearer, the shell being made of an elastic material, and surrounding the insertion space, wherein the shell includes a bottom wall portion configured to support a sole of the foot of the wearer, and a peripheral wall portion that is configured to cover a peripheral surface of the foot of the wearer, the peripheral wall portion extending upward from a peripheral edge of the bottom wall portion, a bulging portion, which bulges toward the insertion space and includes an easy-deformable portion configured as a three-dimensional mesh structure body, is at a position of the peripheral wall portion adapted to correspond to at least one of a portion behind a medial malleolus point of the foot of the wearer and a portion behind a lateral malleolus point of the foot of the wearer, a highly rigid portion, which is a hard-deformable portion having higher rigidity than the easy-deformable portion, is at a position of the peripheral wall portion lower than a portion of the peripheral wall portion provided with the bulging portion, at least a portion of the peripheral wall portion including the bulging portion and the highly rigid portion is configured as a single member, the highly rigid portion has a belt shape extending in a front-rear direction in a portion on a rear end side of the shoe, the peripheral wall portion includes a rib portion that extends in an extending direction of the highly rigid portion in a portion where the highly rigid portion is provided and protrudes toward a side opposite to a side of the insertion space, the highly rigid portion is on an outer surface of a portion corresponding to the rib portion of the peripheral wall portion, the outer surface of the portion of the peripheral wall portion corresponding to the rib portion includes an upper surface and a lower surface separated by one ridge extending in an extending direction of the rib portion, and the highly rigid portion is only on one of the upper surface or the lower surface.

* * * * *